US009153169B2

(12) United States Patent
Yamashita et al.

(10) Patent No.: US 9,153,169 B2
(45) Date of Patent: Oct. 6, 2015

(54) DISPLAY APPARATUS, DRIVING METHOD THEREOF AND ELECTRONIC INSTRUMENT

(75) Inventors: Junichi Yamashita, Tokyo (JP); Katsuhide Uchino, Kanagawa (JP)

(73) Assignee: Sony Corporation, Tokyo (JP)

( * ) Notice: Subject to any disclaimer, the term of this patent is extended or adjusted under 35 U.S.C. 154(b) by 1431 days.

(21) Appl. No.: 12/314,313

(22) Filed: Dec. 8, 2008

(65) Prior Publication Data

US 2009/0179838 A1 Jul. 16, 2009

(30) Foreign Application Priority Data

Jan. 15, 2008 (JP) ..... 2008-005258

(51) Int. Cl.
*G09G 3/32* (2006.01)

(52) U.S. Cl.
CPC ..... *G09G 3/3233* (2013.01); *G09G 2300/0819* (2013.01); *G09G 2300/0842* (2013.01); *G09G 2320/043* (2013.01)

(58) Field of Classification Search
CPC ..... G09G 3/3233; G09G 2300/0842; G09G 2320/043; G09G 2300/0819
See application file for complete search history.

(56) References Cited

U.S. PATENT DOCUMENTS

| | | | | |
|---|---|---|---|---|
| 7,057,588 | B2 | 6/2006 | Asano et al. | |
| 7,071,955 | B2 * | 7/2006 | Miyachi et al. | 345/690 |
| 7,102,202 | B2 | 9/2006 | Kobayashi et al. | |
| 7,109,952 | B2 | 9/2006 | Kwon et al. | |
| 2003/0052614 | A1 * | 3/2003 | Howard | 315/169.1 |
| 2005/0206590 | A1 | 9/2005 | Sasaki et al. | |
| 2005/0231455 | A1 * | 10/2005 | Moon | 345/89 |
| 2006/0138600 | A1 * | 6/2006 | Miyazawa | 257/630 |
| 2006/0170628 | A1 * | 8/2006 | Yamashita et al. | 345/76 |
| 2006/0187154 | A1 * | 8/2006 | Tsuchida | 345/76 |
| 2007/0052656 | A1 * | 3/2007 | Park et al. | 345/100 |
| 2007/0080907 | A1 * | 4/2007 | Park et al. | 345/76 |
| 2007/0081643 | A1 * | 4/2007 | Divine | 379/100.01 |
| 2007/0247399 | A1 | 10/2007 | Yamashita et al. | |

FOREIGN PATENT DOCUMENTS

| | | | |
|---|---|---|---|
| JP | 2003-255856 | A | 9/2003 |
| JP | 2003-271095 | A | 9/2003 |
| JP | 2004-029791 | A | 1/2004 |
| JP | 2004-093682 | A | 3/2004 |

(Continued)

OTHER PUBLICATIONS

Japanese Office Action issued Jan. 5, 2010 for corresponding Japanese Application No. 2008-005258.

*Primary Examiner* — Andrew Sasinowski
*Assistant Examiner* — Mihir Rayan
(74) *Attorney, Agent, or Firm* — Michael Best & Friedrich LLP

(57) ABSTRACT

An image display apparatus includes a pixel array section and a drive section configured to drive the pixel array section. The pixel array section is a pixel-circuit matrix with pixel circuits each serving as a matrix element. The drive section has at least a write scanner for supplying the control signal to each of the scan lines in order to carry out a sequential scanning operation on the scan lines for every field and a signal selector for supplying a video signal to each of the signal lines with a timing adjusted to the sequential scanning operation. Each of the pixel circuits employs at least a sampling transistor, a drive transistor, a signal holding capacitor and a light emitting device.

19 Claims, 17 Drawing Sheets

NO-LIGHT EMISSION PERIOD
(REVERSE BIAS)
Vgs = -6V

(56) References Cited

FOREIGN PATENT DOCUMENTS

| | | | | | |
|---|---|---|---|---|---|
| JP | 2004-118132 | A | | 4/2004 | |
| JP | 2004-133240 | A | | 4/2004 | |
| JP | 2006-119179 | A | | 5/2006 | |
| JP | 2006-208966 | A | | 8/2006 | |
| JP | 2006-215213 | | | 8/2006 | |
| JP | 2006-243740 | A | | 9/2006 | |
| JP | 2007-310311 | A | | 11/2007 | |
| WO | WO 2006/000101 | A1 | * | 1/2006 | ..... G09G 3/32 |

* cited by examiner

LIGHT EMISSION PERIOD
(POSITIVE BIAS)
Vgs = 8V

TURNING OFF THE DRIVE TRANSISTOR
(REVERSE BIAS)
Vgs = -6V

NO-LIGHT EMISSION PERIOD
(REVERSE BIAS)
Vgs = -6V

LIGHT EMISSION PERIOD
(POSITIVE BIAS)
Vgs = 2V

TURNING OFF THE DRIVE TRANSISTOR
(REVERSE BIAS)
Vgs = 0V

NO-LIGHT EMISSION PERIOD
(REVERSE BIAS)
Vgs = 0V

DISPLAY APPARATUS, DRIVING METHOD THEREOF AND ELECTRONIC INSTRUMENT

CROSS REFERENCES TO RELATED APPLICATIONS

The present invention contains subject matter related to Japanese Patent Application JP 2008-005258 filed in the Japan Patent Office on Jan. 15, 2008, the entire contents of which being incorporated herein by reference.

BACKGROUND OF THE INVENTION

1. Field of the Invention

In general, the present invention relates to an active-matrix display apparatus employing a light emitting device in each of its pixel circuits and a driving method for driving the display apparatus. In addition, the present invention also relates to electronic instruments each making use of an image display apparatus of this type.

2. Description of the Related Art

In an image display apparatus such as a liquid-crystal display apparatus, a number of pixel circuits are laid out to form a matrix. The image display apparatus displays an image by controlling the transmissivity or reflectivity of incoming light for each pixel circuit in accordance with information of the image to be displayed. The same method as that adopted by the image display apparatus such as the liquid-crystal display apparatus is also adopted in an organic EL (Electro Luminescence) display apparatus which makes use of an organic EL device in each of its pixel circuits. However, the organic EL display apparatus is different from the liquid-crystal display apparatus in that each of the organic EL devices employed in the organic EL display apparatus is a light self-emitting device. Thus, in comparison with the liquid-crystal display apparatus, the organic EL display apparatus offers merits such as a high visibility, no required backlight and a high response speed. In addition, the organic EL display apparatus is different from the liquid-crystal display apparatus in that the luminance level (or the gradation) of light emitted by the light self-emitting device employed in the organic EL display apparatus is controlled by a current flowing through the light self-emitting device whereas the luminance level of light emitted by the light emitting device employed in the liquid-crystal display apparatus is controlled by a voltage applied to the light emitting device. That is to say, the organic EL display apparatus adopts the so-called current control method whereas the liquid-crystal display apparatus adopts the so-called voltage control method. In the following description, the light self-emitting device employed in the organic EL display apparatus is referred to simply as a light emitting device for the sake of convenience.

Similar to the liquid-crystal display apparatus, the organic EL display apparatus adopts a driving method which can be a simple matrix driving method or an active matrix driving method. The simple matrix driving method has a simple structure. However, the simple matrix driving method raises a problem that it is difficult to implement an organic EL display apparatus having a large size and a high definition. For this reason, the active matrix driving method is being developed extensively at the present day. In accordance with the active matrix driving method, a current flowing through the light emitting device employed in each pixel circuit of the organic EL display apparatus is controlled by making use of an active device such as a TFT (Thin Film Transistor) also employed in the pixel circuit. For more information on the organic EL display apparatus and the active matrix driving method adopted, refer to Japanese Patent Laid-open Nos. 2003-255856, 2003-271095, 2004-133240, 2004-029791, 2004-093682, and 2006-215213

SUMMARY OF THE INVENTION

Each of the pixel circuits in related art arranged to form a matrix is an element of the matrix provided at an intersection of a scan line stretched as one of rows of the matrix to serve as a line for supplying a control signal to the pixel circuit and a signal line stretched as one of columns of the matrix to serve as a line for supplying a video signal to the pixel circuit. Each of the pixel circuits in related art employs at least a sampling transistor, a signal holding capacitor, a drive transistor and a light emitting device. In each pixel circuit, the sampling transistor enters a turned-on state in accordance with a control signal supplied by a scan line, sampling a video signal supplied by a signal line. The signal holding capacitor is used for holding an input voltage representing the electric potential of the video signal sampled by the sampling transistor. The drive transistor provides the light emitting device with an output current according to the input voltage, which is held in the signal holding capacitor, during a light emission period determined in advance. This output current is also referred to as a driving current. It is to be noted that, in general, the output current is also dependent on the mobility of carriers in a channel area of the drive transistor and dependent on the threshold voltage of the drive transistor. The light emitting device emits light with a luminance determined by the driving current output by the drive transistor as an output current according to the input voltage, which has been stored in the signal holding capacitor as a voltage representing a video signal.

The input voltage held in the signal holding capacitor as a voltage representing a video signal is supplied to the gate electrode of the drive transistor in order to flow the output current between the source and drain electrodes of the drive transistor which then supplies the output current to the light emitting device as the driving current cited above. In general, the luminance of light emitted by the light emitting device is proportional to the magnitude of the driving current which is controlled by a voltage held in the signal holding capacitor and applied to the gate electrode of the drive transistor. As described above, the voltage applied to the gate electrode of the drive transistor is the input voltage representing the video signal. That is to say, the pixel circuit in related art changes the input voltage applied to the gate electrode of the drive transistor in accordance with the video signal supplied to the pixel circuit through the signal line in order to control the drive current supplied to the light emitting device, that is, in order to control the luminance of light emitted by the light emitting device.

The operating characteristic of the drive transistor is represented by Equation (1) as follows:

$$Ids=(1/2)\mu(W/L)Cox(Vgs-Vth)^2 \quad (1)$$

In Equation (1) representing the operating characteristic of the drive transistor, reference notation Ids denotes a drain current which flows between the source and drain electrodes of the drive transistor. In this patent specification, the drain-source current is the aforementioned output current or the driving current cited above. Thus, the drain-source current is supplied to the light emitting device employed in the pixel circuit. Reference notation Vgs denotes a gate voltage applied to the gate electrode of the drive transistor with a source voltage taken as a reference voltage. The gate voltage is the input voltage mentioned before. As described previously, the input voltage represents a video signal supplied to the pixel circuit through the signal line. Reference notation Vth denotes the threshold voltage of the drive transistor whereas reference notation Cox denotes the capacitance of a gate capacitor of the drive transistor. As is obvious from Equation (1) representing the operating characteristic of the drive transistor which is a thin film transistor, with the drive transistor operating in a saturated region, if the gate-source voltage Vgs exceeds the threshold voltage Vth, the drive transistor enters a turned-on state, allowing the drain current Ids to flow. As is obvious from Equation (1) representing the operating characteristic of the drive transistor, in principle, if the gate-source voltage Vgs is fixed, a drain-source current Ids having a constant magnitude always flows to the light emitting device. Thus, if a video signal of a uniform level is supplied to all pixel circuits composing the display screen of the organic EL display apparatus, all the pixel circuits should emit light beams having a uniform luminance, exhibiting uniformity of the display screen.

In actuality, however, the TFT (Thin Film Transistor) made of a semiconductor thin film such as the poly silicon has device characteristics that vary from transistor to transistor. In particular, the threshold voltage Vth is not uniform among TFTs. Instead, the threshold voltage Vth varies from transistor to transistor, that is, from pixel to pixel. As is obvious from Equation (1) given before as an equation representing the operating characteristic of the drive transistor, if the threshold voltage Vth of the drive transistor varies from pixel to pixel, the drain current Ids also varies from pixel to pixel as well even if the gate-source voltage Vgs is uniform for all the pixel circuits. Thus, the luminance of light generated by the light emitting device also varies from pixel to pixel as well. As a result, the uniformity of the display screen is lost. In order to solve this problem, there has been developed a pixel circuit that has a built-in function for eliminating the inherent variations of the threshold voltage Vth of the drive transistor from pixel to pixel. For more information on such a pixel circuit, the reader is suggested to refer to Japanese Patent Laid-open No. 2004-133240.

As described above, due to effects of a manufacturing process to create the drive transistor, the drive transistor has a threshold voltage Vth that varies from transistor to transistor. However, these inherent variations in threshold voltage Vth from transistor to transistor can be dealt with by providing the pixel circuit with a threshold-voltage correction function for eliminating the effect of the inherent variations. In addition to the inherent variations in threshold voltage Vth from transistor to transistor, the threshold voltage Vth also tends to change with the lapse of time. If the threshold voltage Vth varies with the lapse of time and due to the inherent variations by a change beyond a range that can be handled by the correction power of the threshold-voltage correction function, the pixel circuit can no longer be compensated for the effects of the change in threshold voltage Vth with the lapse of time and the effects of the change due to the inherent variations in threshold voltage Vth from transistor to transistor. As a result, the display screen shows luminance unevenness. In order to provide the threshold-voltage correction function embedded in the pixel circuit with a margin for handling anticipated changes in threshold voltage Vth with the lapse of time, it is necessary to increase a power-supply voltage applied to the pixel circuit. However, the raised voltage of the power supply undesirably gives rise to an increase in power consumption.

Addressing the problems described above, it is desirable to provide an image display apparatus capable of avoiding variations of the threshold voltage Vth of the drive transistor with the lapse of time and eliminating the effects of the change due to the inherent variations in threshold voltage Vth from transistor to transistor, a driving method for driving the image display apparatus, and an electronic instrument employing the image display apparatus. In order to implement such an image display apparatus, the image display apparatus is provided with means described as follows. The image display apparatus provided by an embodiment of the present invention employs a pixel array section and a drive section configured to drive the pixel array section. The pixel array section is a pixel-circuit matrix with pixel circuits each serving as a matrix element. Each of the pixel circuits is provided at an intersection of a scan line stretched as one of rows of the matrix to serve as a line for supplying a control signal to the pixel circuit and a signal line stretched as one of columns of the matrix to serve as a line for supplying a video signal to the pixel circuit. The drive section has at least a write scanner for supplying a control signal to each of the scan lines in order to carry out a sequential scanning operation on the scan lines for every field and a signal selector for supplying a video signal to each of the signal lines with a timing adjusted to the sequential scanning operation. Each of the pixel circuits employs at least a sampling transistor, a signal holding capacitor, a drive transistor and a light emitting device. In each of the pixel circuits, the gate electrode of a sampling transistor is connected to one of the scan lines. The source and drain electrodes of the sampling transistor are connected between one of the signal lines and the gate electrode of the drive transistor. The drain electrode of the drive transistor is connected to a power-supply line whereas the source electrode of the drive transistor is connected to the light emitting device. The signal holding capacitor is connected between the gate and source electrodes of the drive transistor. The sampling transistor enters a turned-on state in accordance with a control signal supplied by the scan line, sampling a video signal supplied by the signal line and then stores the sampled video signal into the signal holding capacitor. The drive transistor supplies the light emitting device with a driving current having a magnitude according to the video signal held by the signal holding capacitor. The image display apparatus described above is characterized in that: each of the pixel circuits operates in a light emission period and a no-light emission period which together compose the period of a field; the signal selector provides each of the signal lines with a video signal, and a predetermined reference potential for providing the gate and source electrodes of the drive transistor with a reverse bias for putting the drive transistor in a turned-off state and, hence, driving the light emitting device to cease to emit light; the write scanner provides each individual one of the scan lines with the control signal for acquiring the video signal from the individual signal line, and another control signal for acquiring the predetermined reference potential from the individual signal line; the sampling transistor acquires the predetermined reference potential from the signal line in accordance with the other control signal supplied by the write scanner, applying the predetermined reference potential to the gate electrode of the drive transistor in order to drive the light emitting device to cease to emit light and make a transition from the no-light emission period to the light emission period; and, by applying the predetermined reference potential to the gate electrode of the drive transistor, a voltage applied between the gate and source electrodes of the drive transistor is put in a state of a reverse bias, the magnitude of which is determined in accordance with the level of the video signal, so as to repress variations of the threshold voltage Vth of the drive transistor.

It is preferable to provide a configuration in which the signal selector sets the predetermined reference potential at an optimal value so that: when the video signal is set at a white level, the voltage applied between the gate and source electrodes of the drive transistor is put in a state of a maximum reverse bias the magnitude of which is determined by the optimum value of the predetermined reference potential Vss1 and the electric potential of the video signal corresponding to the white level; and when the video signal is set at a black level, the voltage applied between the gate and source electrodes of the drive transistor becomes a zero level or approaches the zero level, entering a state of a minimum reverse bias the magnitude of which is determined by the optimum value of the predetermined reference potential Vss1 and the electric potential of the video signal corresponding to the black level.

In addition, it is also preferable to provide a configuration in which the write scanner provides the scan line with a pulse serving as the other control signal so that, with a fixed trip supplied to the source electrode of the drive transistor, the sampling transistor instantaneously applies the predetermined reference potential to the gate electrode of the drive transistor to reverse an electric potential at the gate electrode of the drive transistor with respect to the fixed electric potential at the source electrode of the drive transistor, putting the drive transistor in a state of a reverse bias.

On top of that, it is also preferable to provide a configuration in which the write scanner adjusts the phase of the other control signal supplied to the scan line in order to optimize the ratio of the light emission period to the no-light emission period so that a threshold-voltage change in a state of a forward bias applied between the gate and source electrodes of the drive transistor during the light emission period is canceled by a threshold-voltage change in a state of a reverse bias applied between the gate and source electrodes of the drive transistor during the no-light emission period.

In addition, it is also preferable to provide a configuration in which, prior to an operation to sample the video signal, the driving current is flowed through the drive transistor with a timing T3 shown in the timing diagram of FIG. 3 or 5 by changing a power-supply voltage asserted on a power-supply line VL from an electric potential Vss2 to an electric potential Vcc, raising an electric potential on the source electrode of the drive transistor due to electrical charging of the signal holding capacitor till the difference in electric potential between the gate and drain electrodes of the drive transistor becomes equal to the threshold voltage of the drive transistor so that the drive transistor is put in a turned-off state of cutting off the driving current flowing through drive transistor and a voltage, which is appearing between the gate and source electrodes of the drive transistor at the time the driving current flowing through the drive transistor is cut off, is stored in the signal holding capacitor in order to carry out a threshold-voltage compensation operation to compensate the drive transistor for an effect of variations in threshold voltage from pixel to pixel. At a time corresponding to the timing T3, the electric potential on the source of the drive transistor is not high enough to put the light emitting device in a turned-on state so that a driving current generated by the drive transistor does not flow to the light emitting device, but flows to the signal holding capacitor, electrical charging of the signal holding capacitor.

On top of that, it is also preferable to provide a configuration in which, when the sampling transistor is put in a turned-on state in order to store a video signal in the signal holding capacitor, a driving current flowing through the drive transistor is negatively fed back to the signal holding capacitor during a mobility compensation period determined in advance in order to compensate the drive transistor for an effect of variations in carrier mobility.

In accordance with an embodiment of the present invention, each of the pixel circuits employed in the image display apparatus operates in a light emission period and a no-light emission period which compose the period of a field. In the light emission period, a forward bias is applied between the gate and source electrodes of the drive transistor in order to put the drive transistor in a turned-on state which allows a driving current to flow to the light emitting device. By applying a forward bias between the gate and source electrodes of the drive transistor, the threshold voltage of the drive transistor changes in the positive direction (or increases) with the lapse of time. In the no-light emission period, on the other hand, a reverse bias is applied between the gate and source electrodes of the drive transistor in order to put the drive transistor in a turned-off state which does not allow a driving current to flow to the light emitting device. By applying a reverse bias between the gate and source electrodes of the drive transistor, the threshold voltage of the drive transistor tends to change in the negative direction (or decrease) with the lapse of time. Such a property of the drive transistor is utilized to make the upward-direction shift (or the increase) of the threshold voltage in the light emission period and the downward-direction shift (or the decrease) of the threshold voltage in the no-light emission period cancel each other so that, if both the upward-direction shift of the threshold voltage in the light emission period and the downward-direction shift of the threshold voltage in the no-light emission period are taken into consideration, the threshold voltage is controlled not to change much with the lapse of time during the period of a field.

In particular, in accordance with an embodiment of the present invention, in order to apply a reverse bias between the gate and source electrodes of the drive transistor in the no-light emission period, at a moment the pixel circuit is supposed to make a transition from the light emission period to the no-light emission period, the sampling transistor is put in a turned-on state instantaneously to acquire an electric potential determined in advance from the signal line and applies the electric potential to the gate electrode of the drive transistor. By applying the electric potential determined in advance to the gate electrode of the drive transistor, a voltage applied between the gate and source electrodes of the drive transistor can be put in a state of a reverse bias because, at that time, the source electrode of the drive transistor is sustained at a fixed electric potential lower than the electric potential determined in advance. In the state of a reverse bias, the magnitude of the reverse bias is determined in accordance with the level of the video signal. If the level of the video signal is the white level, for example, a gate-source voltage Vgs applied to the gate electrode of the drive transistor has a large magnitude resulting in a large forward bias in a light emission period. Thus, the threshold voltage of the drive transistor tends to change largely in the upward direction (or tends to increase by a big change). When the pixel circuit makes a transition from the light emission period a no-light emission period due to the reverse bias described above, on the other hand, the voltage applied between the gate and source electrodes of the drive transistor is changed from a state of a forward bias to a state of a reverse bias and the magnitude of the reverse bias is automatically set at a value appropriate for the forward bias in the light emission period in the state immediately preceding the state of a reverse bias. Thus, the threshold voltage of the drive transistor tends to change largely in the downward direction (or tends to decrease by a big change) in the no-light emission period. With such a configuration, the image display apparatus provided by an embodiment of the present invention can be made capable of well repressing variations generated with the lapse of time as drifts of the threshold voltage of the drive transistor. As a result, it is not necessary to set the power of the threshold-voltage compensation function built in the pixel circuit at a large value which requires that an operating voltage supplied by a power supply of the pixel circuit be raised. In addition, the small operating voltage supplied by the power supply of the pixel circuit at a low level contributes to reduction of the power consumption of the image display apparatus.

DETAILED DESCRIPTION OF THE PREFERRED EMBODIMENTS

Figure 1:
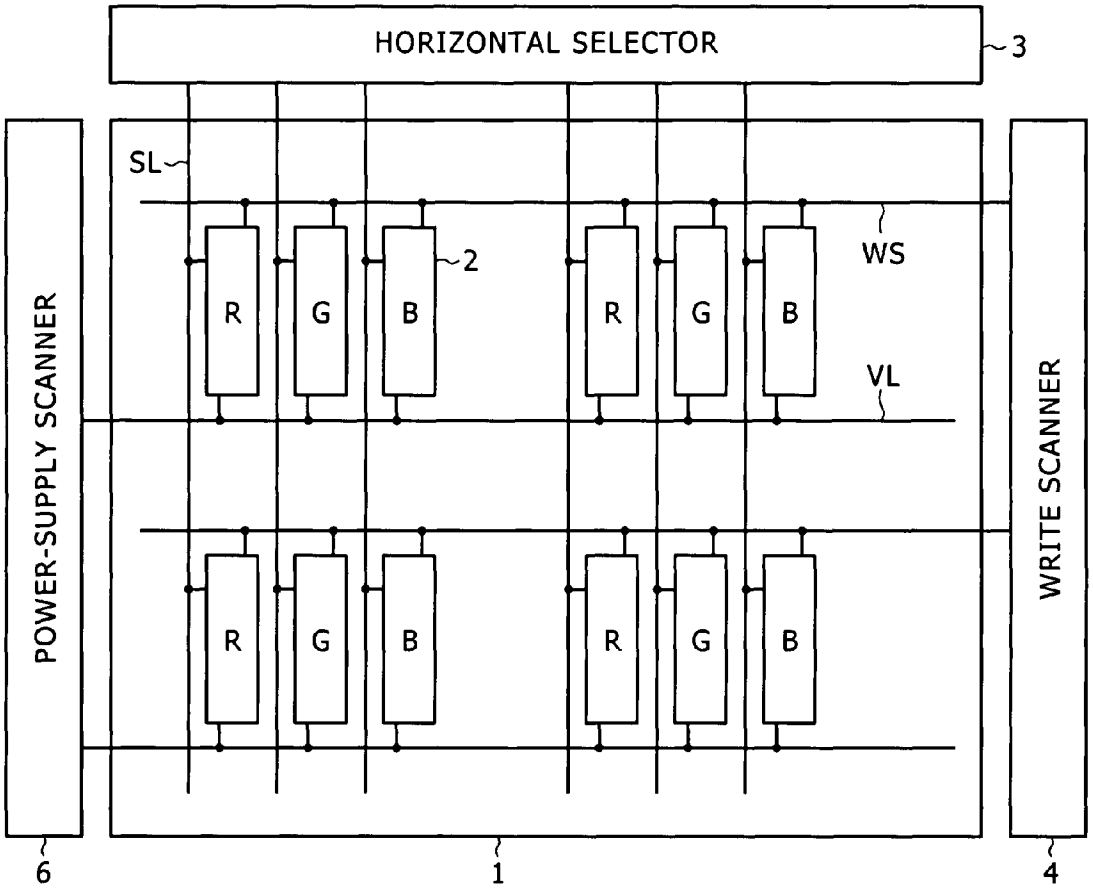
FIG. 1 is a block diagram showing the entire configuration of an image display apparatus according to an embodiment of the present invention.

Preferred embodiments of the present invention are explained in detail as follows. FIG. 1 is a block diagram showing the entire configuration of an image display apparatus according to an embodiment of the present invention. As shown in FIG. 1, the image display apparatus employs a pixel array section 1 and a drive section configured to drive the pixel array section 1. The pixel array section 1 is a matrix having pixel circuits 2 each serving as an element of the matrix. The pixel array section 1 includes scan lines WS each serving as one of rows of the matrix, signal lines SL each serving as one of columns of the matrix, the pixel circuits 2 each located at an intersection of one of the scan lines WS and one of the signal lines SL and power-supply lines VL also each serving as one of the rows of the matrix in conjunction with one of the scan lines WS. It is to be noted that, in this embodiment, each of the pixel circuits 2 is assigned to one of the three primary colors, i.e., the RGB (red, green, and blue) colors, making it possible to show a color display on the display screen. However, the configuration of the image display apparatus is by no means limited to such an arrangement of pixel circuits 2 for the three primary colors. For example, the pixel circuits 2 can also be provided for showing a single-color display. The drive section includes a write scanner 4 for supplying a control signal to each of the scan lines WS in order to carry out a sequential scanning operation for every row, a power-supply scanner 6 for supplying a power-supply voltage to each of the power-supply lines VL with a timing adjusted to the line-sequential scanning operation and a horizontal selector 3 for supplying electric potentials to each of the signal lines SL with a timing adjusted to the line-sequential scanning operation. The power-supply voltage is properly switched from a first electric potential to a second electric potential and vice versa. The electric potentials supplied to a signal line SL are an electric potential representing a video signal and a predetermined reference potential.

Figure 2:
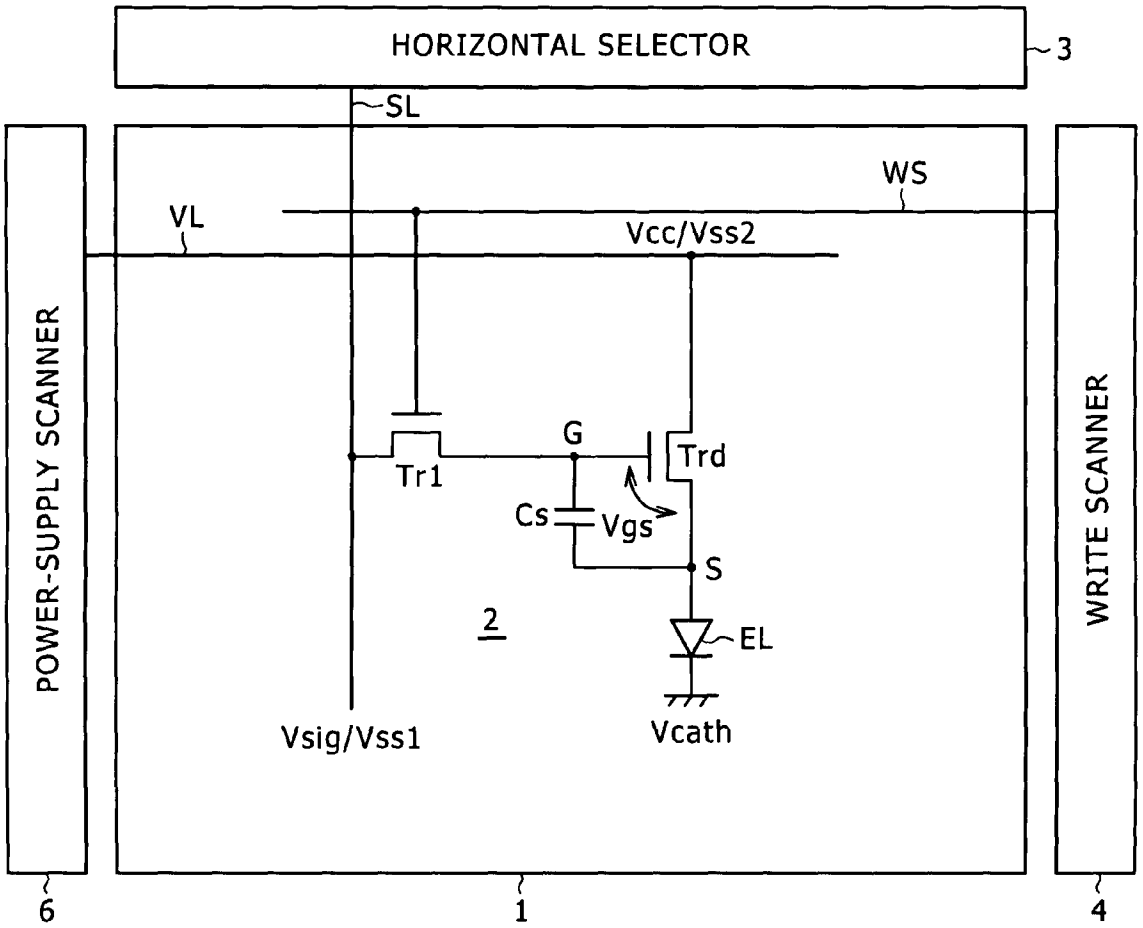
FIG. 2 is a circuit diagram showing the concrete configuration and wiring of each of pixel circuits 2 employed in the image display apparatus shown in the block diagram of FIG. 1.

FIG. 2 is a circuit diagram showing the concrete configuration and wiring of each of the pixel circuits 2 employed in the image display apparatus shown in FIG. 1. As shown in FIG. 2, the pixel circuit 2 employs a light emitting device EL, a sampling transistor Tr1, a drive transistor Trd and a signal holding capacitor Cs. A representative light emitting device EL is an organic EL device. Used as the control terminal of the sampling transistor Tr1, the gate electrode of the sampling transistor Tr1 is connected to one of the scan lines WS. One of the source and drain electrodes of the sampling transistor Tr1 is connected to one of the signal lines SL whereas the other electrode is connected to the gate electrode G of the drive transistor Trd. The source and drain electrodes of the sampling transistor Tr1 form a pair of current terminals. Much like the sampling transistor Tr1, the gate electrode G of the drive transistor Trd is used as the control terminal of the drive transistor Trd. One of the drain electrode D of the drive transistor Trd and the source electrode S of the drive transistor Trd is connected to one of the power-supply lines VL whereas the other electrode of the drive transistor Trd is connected to the anode electrode of the light emitting device EL. In this embodiment, the drive transistor Trd is a transistor of the N-channel type. Thus, the drain electrode D of the drive transistor Trd is connected to one of the power-supply lines VL whereas the source electrode S of the drive transistor Trd is connected to the anode electrode of the light emitting device EL. The cathode electrode of the light emitting device EL is connected to a predetermined cathode electric potential Vcath. The signal holding capacitor Cs is connected between the gate electrode G and the source electrode S of the drive transistor Trd. As described earlier, the gate electrode G of the drive transistor Trd is the control terminal of the drive transistor Trd whereas and the source electrode S of the drive transistor Trd is one of the current terminals of the drive transistor Trd.

In the circuit configuration described above, the sampling transistor Tr1 is put in a turned-on state by a control signal supplied from the scan line WS. In this turned-on state, the sampling transistor Tr1 samples an electric potential Vsig supplied from the signal line SL and stores the sampled electric potential Vsig in the signal holding capacitor Cs. During the turned-on state, the power-supply line VL is supplying the first electric potential also referred to as a high electric potential Vcc to the drain electrode D of the drive transistor Trd, causing the drive transistor Trd to provide the light emitting device EL with a driving current determined by the video-signal electric potential Vsig stored in the signal holding capacitor Cs. In order to put the sampling transistor Tr1 in a turned-on state for a time period during which the electric potential Vsig of the video signal is appearing on the signal line SL, the write scanner 4 outputs the control signal to the scan line WS as a control pulse having a predetermined width. During this time period, the sampling transistor Tr1 stores the electric potential Vsig of the video signal in the signal holding capacitor Cs as described above and, at the same time, the driving current flowing through the drive transistor Trd is negatively fed back to the signal holding capacitor Cs in order to execute a mobility compensation function for compensating the drive transistor Trd for an effect of variations of the carrier mobility of the drive transistor Trd from pixel to pixel. Then, the pixel circuit 2 starts a light emission period in which the drive transistor Trd provides the light emitting device EL with a driving current determined by the video-signal electric potential Vsig stored in the signal holding capacitor Cs.

In addition to the mobility compensation function described above, the pixel circuit 2 is also provided with a threshold-voltage compensation function which is executed by, first of all, switching the power-supply voltage asserted by the power-supply scanner 6 on the power-supply line VL from the first electric potential also referred to as a high electric potential Vcc to the second electric potential also referred to as a low electric potential Vss2 with a first timing prior to the operation carried out by the sampling transistor Tr1 to sample the electric potential Vsig. In addition, also prior to the operation carried out by the sampling transistor Tr1 to sample the electric potential Vsig of the video signal, the write scanner 4 supplies a control pulse to the gate electrode of the sampling transistor Tr1 through the scan line WS to serve as another control signal with a second timing in order to put the sampling transistor Tr1 in a turned-on state. In this turned-on state, the sampling transistor Tr1 samples a predetermined reference potential Vss1 supplied by the horizontal selector 3 through the signal line SL and stores the sampled predetermined reference potential Vss1 in the signal holding capacitor Cs so as to apply the predetermined reference potential Vss1 to the gate electrode G of the drive transistor Trd. At the beginning of the turned-on state, the power-supply voltage applied to the drain electrode D of the drive transistor Trd through the power-supply line VL is still sustained by the power-supply scanner 6 at the second electric potential also referred to as the low electric potential Vss2. With a third timing lagging behind the second timing, however, the power-supply scanner 6 changes the power-supply voltage applied to the drain electrode D of the drive transistor Trd through the power-supply line VL from the second electric potential also referred to as the low electric potential Vss2 back to the first electric potential also referred to as the high electric potential Vcc and, thus, the drain-source current Ids flowing through the drive transistor Trd electrically charges the signal holding capacitor Cs. As a result, a voltage corresponding to the threshold voltage Vth of the drive transistor Trd is applied between the source electrode S of the drive transistor Trd and the gate electrode G of the drive transistor Trd and stored in the signal holding capacitor Cs. By execution of the threshold-voltage compensation function, the image display apparatus is capable of eliminating the effect of the variations of the threshold voltage Vth from pixel to pixel.

The pixel circuit 2 is further provided with the bootstrap function based on a capacitive coupling effect of the signal holding capacitor Cs to serve as a function which is executed by removing a control pulse such as a control pulse applied by the write scanner 4 to the gate electrode of the sampling transistor Tr1 through the scan line WS to serve as the control signal as soon as the electric potential Vsig of the video signal is stored in the signal holding capacitor Cs. With the control pulse removed, the sampling transistor Tr1 is put in a turned-off state of electrically disconnecting the gate electrode G of the drive transistor Trd from the signal line SL and putting the gate electrode G in a floating state. With the gate electrode G of the drive transistor Trd electrically disconnected from the signal line SL and put in a floating state, the electric potential on the gate electrode G of the drive transistor Trd changes in a manner of being interlocked with a change of the electric potential on the source electrode S of the drive transistor Trd due to the capacitive coupling effect of the signal holding capacitor Cs. Thus, a gate-source voltage Vgs between the gate electrode G of the drive transistor Trd and the source electrode S of the drive transistor Trd can be sustained at a constant magnitude.

The present invention is characterized in that each of the pixel circuits 2 operates in a light emission period and a no-light emission period which together compose the period of a field.

The write scanner 4 provides each of the scan lines WS with the control pulse serving as the control signal for acquiring the electric potential Vsig of the video signal from a signal line SL, and the control pulse serving as the other control signal for acquiring the predetermined reference potential Vss1 from the signal line SL. The sampling transistor Tr1 acquires the predetermined reference potential Vss1 from the signal line SL in accordance with the other control signal supplied by the write scanner 4, applying the predetermined reference potential Vss1 to the gate electrode G of the drive transistor Trd. In addition, by applying the predetermined reference potential Vss1 to the gate electrode G of the drive transistor Trd, as will be described later, a voltage applied between the gate electrode G of the drive transistor Trd and the source electrode S of the drive transistor Trd is put in a state of a reverse bias, the magnitude of which is determined in accordance with the level of the video signal, so as to repress variations generated with the lapse of time as variations of the threshold voltage Vth of the drive transistor Trd.

The horizontal selector 3 sets the predetermined reference potential at an optimal value so that when the electric potential of the video signal is set at a white level, the gate-source voltage Vgs applied between the gate electrode G of the drive transistor Trd and the source electrode S of the drive transistor Trd is put in a state of a maximum reverse bias. When electric potential of the video signal Vsig is set at a black level, on the other hand, the voltage applied between the gate electrode G of the drive transistor Trd and the source electrode S of the drive transistor Trd becomes a zero level or approaches the zero level, entering a state of a minimum reverse bias. For example, the signal selector 3 is optimized by setting the predetermined potential to the reference potential Vss1. In addition, the write scanner 4 provides the scan line WS with a control pulse serving as the control signal for making a transition from the light emission period to the no-light emission period so that, with an approximately fixed voltage supplied to the source electrode S of the drive transistor Trd, the sampling transistor Tr1 instantaneously applies the predetermined reference potential Vss1 to the gate electrode G of the drive transistor Trd to reverse an electric potential at the gate electrode G of the drive transistor Trd with respect to an electric potential at the source electrode S of the drive transistor Trd, putting the drive transistor Trd in a state of a reverse bias. In some cases, the write scanner 4 adjusts the phase of the control signal supplied as the third control pulse to the scan line WS in order to optimize the ratio of the light emission period to the no-light emission period so that an upward-direction threshold-voltage change in a state of a forward bias applied between the gate electrode S of the drive transistor Trd and the source electrode S of the drive transistor Trd during the light emission period is canceled by a downward-direction threshold-voltage change in a state of a reverse bias applied between the gate electrode S of the drive transistor Trd and the source electrode S of the drive transistor Trd during the no-light emission period.

Figure 3:
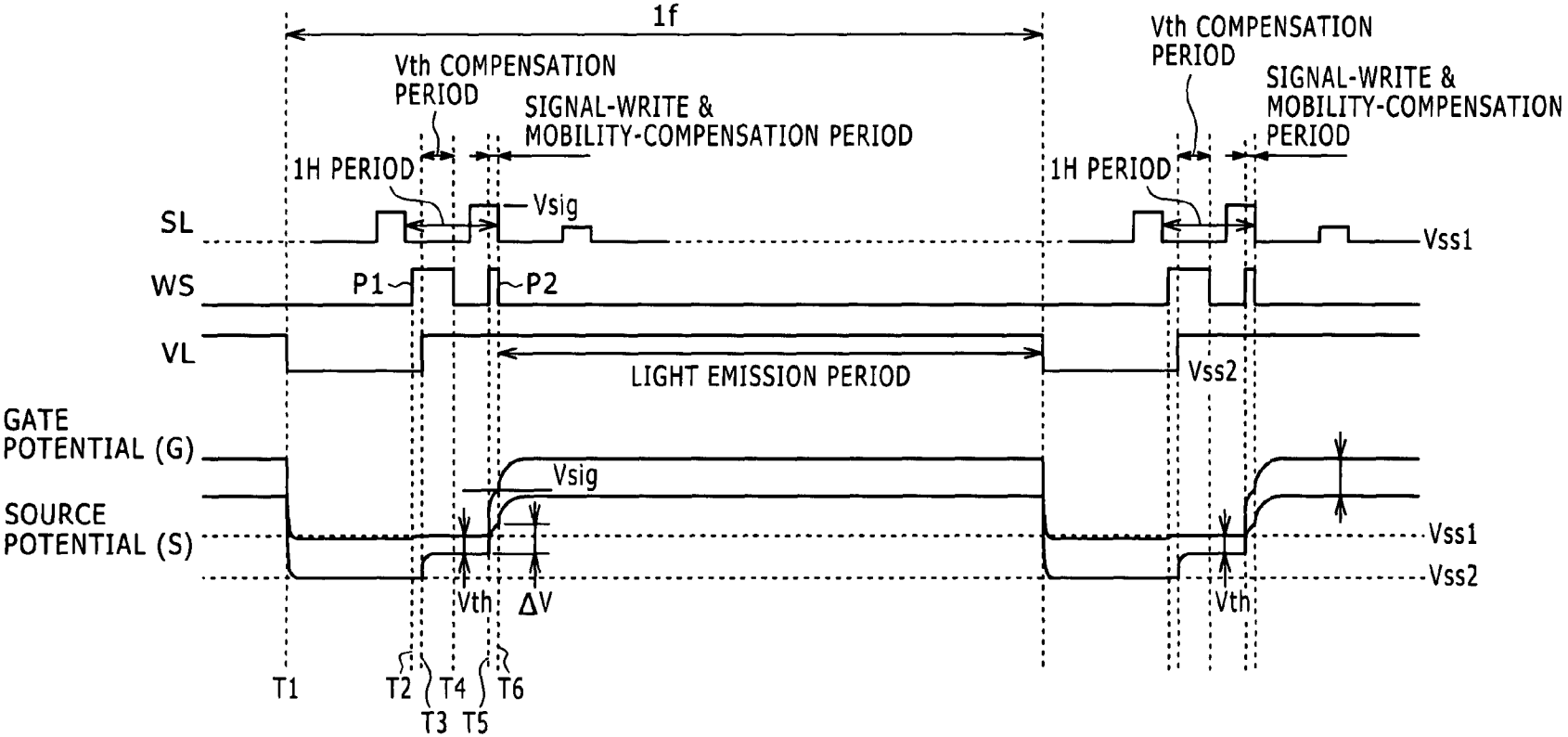
FIG. 3 is a timing diagram showing timing charts to be referred to in explanation of a sequence of operations carried out by the pixel circuit 2 shown in the circuit diagrams of FIG. 2.

FIG. 3 is a timing diagram showing timing charts referred to in explanation of a sequence of operations carried out by the pixel circuit 2 shown in FIG. 2. However, these timing charts are timing charts for operations carried out by the pixel circuit 2 in a typical example of a previously developed display apparatus which has been used as a base of the image display apparatus provided by an embodiment of the present invention. The operations carried out in the typical example of the previously developed display apparatus do not include an operation to make a transition from the light emission period to the no-light emission period as a transition. First of all, a sequence of the operations carried out by the typical example of the previously developed display apparatus is explained in detail as a part of the present invention. The typical example of the previously developed display apparatus is an embodiment provided prior a configuration for carrying out a countermeasure to eliminate variations of the threshold voltage Vth of the drive transistor Trd with the lapse of time. Used for representing the lapse of time, the horizontal axis is an axis common to all the timing charts. The vertical axis represents changes of electric potential changes appearing on the signal line SL, the scan line WS and the power-supply line VL. In addition, the vertical axis also represents changes of electric potentials on the gate electrode S of the drive transistor Trd and the source electrode S of the drive transistor Trd.

A control pulse signal is supplied to the gate electrode of the sampling transistor Tr1 through the scan line WS in order to put the sampling transistor Tr1 in a turned-on state. The control pulse signal is asserted on the scan line WS at intervals each corresponding to the period of one field (1f) in synchronization with the line sequential scanning operation carried out on the pixel matrix array section. To put it in more detail, during one horizontal scanning period (1H), two pulses are generated as the control pulse signal. The first one of the two pulses is referred to as a first control pulse P1 whereas the second one is referred to as a second control pulse P2. Also during one horizontal scanning period (1H), the voltage asserted on the signal line SL is set at the predetermined reference potential Vss1 as an electric potential and then changed to the electric potential Vsig of the video signal as an electric potential. During the period of one field (1f) cited above, the voltage asserted on the power-supply line VL is changed from the high electric potential Vcc to the low electric potential Vss2 and from the low electric potential Vss2 back to the high electric potential Vcc.

As shown in FIG. 3, in the period of 1f, the pixel circuit 2 terminates the light emission period and starts the no-light emission period and, later on, the pixel circuit 2 terminates the no-light emission period and starts the light emission period. During the no-light emission period between the timings T1 and T6, the following operations are carried out: a preparatory operation during the period between the timings T1 and T3; a threshold-voltage compensation operation during the period between the timings T3 and T4; a signal write operation and a mobility compensation operation. The signal write operation and the mobility compensation operation are carried out during the period between the timings T5 and T6.

During the light emission period of a field, the power-supply line VL is set at the high electric potential Vcc and the drive transistor Trd is flowing a driving current Ids to the light emitting device EL. To put it in detail, the driving current Ids is flowing from the power-supply line VL set at the high electric potential Vcc to the cathode electrode of the light emitting device EL by way of the drive transistor Trd and the light emitting device EL.

Then, with the timing T1, the voltage on the power-supply line VL is changed from the high electric potential Vcc to the low electric potential Vss2 in order to terminate the light emission period of the field and start the no-light emission period of the field. That is to say, the power-supply line VL is electrically discharged from the high electric potential Vcc to the low electric potential Vss2. Thus, the electric potential on the source electrode S of the drive transistor Trd also decreases from approximately the high electric potential Vcc to approximately the low electric potential Vss2. As a result, the electric potential on the anode electrode of the light emitting device EL is put in a state of a reverse bias so that the driving current Ids ceases to flow though the light emitting device EL. In addition, since the gate electrode G of the drive transistor Trd is electrically disconnected from the signal line SL and put in a floating state till the first control pulse P1 appears with the timing T2, the electric potential on the gate electrode G of the drive transistor Trd also decreases from approximately the electric potential Vsig of the video signal to approximately the predetermined reference potential Vss1 in a manner of being interlocked with the source electrode S of the drive transistor Trd.

With the timing T2, the first control pulse P1 is asserted on the scan line WS to raise the electric potential on the scan line WS from a low level to a high level, putting the sampling transistor Tr1 in a turned-on state. At that time, the signal line SL is at the predetermined reference potential Vss1. Connected to the signal line SL by the sampling transistor Tr1 put in a turned-on state, the gate electrode G of the drive transistor Trd thus rises to the predetermined reference potential Vss1. At that time, the source electrode S of the drive transistor Trd is at the low electric potential Vss2 which is sufficiently lower than the predetermined reference potential Vss1. In this way, the gate-source voltage Vgs between the gate electrode G of the drive transistor Trd and the source electrode S of the drive transistor Trd is initialized at the difference of (Vss1−Vss2) which is greater than the threshold voltage Vth of the drive transistor Trd. The period between the timings T1 and T3 is referred to as a preparatory period.

Then, with the timing T3, the voltage on the power-supply line VL is raised from the low electric potential Vss2 back to the high electric potential Vcc. At that time, the electric potential on the source electrode S also starts rising. As the gate-source voltage Vgs between the gate electrode G of the drive transistor Trd and the source electrode S of the drive transistor Trd becomes equal to the threshold voltage Vth of the drive transistor Trd, the driving current Ids flowing through the drive transistor Trd is cut off. In this way, a voltage corresponding to the threshold voltage Vth of the drive transistor Trd is stored in the signal holding capacitor Cs. With the timing T4, the first control pulse P1 is removed to change the electric potential on the scan line WS from a high level to a low level so as to put sampling transistor Tr1 in a turned-off state of electrically disconnecting the gate electrode G of the drive transistor Trd from the signal line SL and putting the gate electrode G in a floating state sustaining the gate-source voltage Vgs between the gate electrode G of the drive transistor Trd and the source electrode S of the drive transistor Trd or the voltage stored in the signal holding capacitor Cs at a constant value equal to the threshold voltage Vth of the drive transistor Trd. The period between the timings T3 and T4 is a period during which the threshold-voltage compensation operation is carried out. On the other hand, the period between the timings T1 and T3 is a period during which the preparatory operation cited above is carried out. In order to flow the drain-source current Ids to the signal holding capacitor Cs instead of flowing to the light emitting device EL at these times, the cathode electric potential Vcath is set at a proper level sustaining the light emitting device EL in a cut-off state of flowing no current.

As is obvious from the above description, in order to carry out the threshold-voltage compensation operation in the period between the timings T3 and T4, it is necessary to apply the first control pulse P1 to the gate electrode of the sampling transistor Tr1 with the timing T2 and remove the second control pulse P2 with the timing T4.

At a point of time between the timing T4 and a timing T5, the voltage on the signal line SL is changed from the predetermined reference potential Vss1 to the electric potential Vsig of the video signal. Then, with the timing T5, the electric potential on the scan line WS is raised from a low level to a high level. In other words, with the timing T5, the second control pulse P2 is applied to the gate electrode of the sampling transistor Tr1 in order to put the sampling transistor Tr1 in a turned-on state again. In this turned-on state, the sampling transistor Tr1 samples the electric potential Vsig of the video signal from the signal line SL and supplies the electric potential Vsig of the video signal to the gate electrode G of the drive transistor Trd, storing the electric potential Vsig of the video signal in the signal holding capacitor Cs. The light emitting device EL is initially in a high-impedance state of cutting off the drain-source current Ids generated by the drive transistor Trd. Thus, the drain-source current Ids flows to only the signal holding capacitor Cs and an equivalent capacitor of the light emitting device EL, starting electrical charging processes of the signal holding capacitor Cs and the equivalent capacitor. With the timing T6, however, as a result of the electrical charging processes of the signal holding capacitor Cs and the equivalent capacitor, the electric potential on the source electrode S of the drive transistor Trd and the anode electrode of the light emitting device EL has been raised to a level high enough to put the light emitting device EL in a turned-on state. With the light emitting device EL put in a turned-on state, the pixel circuit 2 terminates the no-light emission period and commences the light emission period.

During the period between the timings T5 and T6, the electric potential on the source electrode S of the drive transistor Trd rises by an increase ΔV. In this way, the electric potential Vsig of the video signal representing the video signal is stored in the signal holding capacitor Cs over a voltage stored in advance in the signal holding capacitor Cs as a voltage corresponding to the threshold voltage Vth of the drive transistor Trd and, at the same time, the voltage difference ΔV for compensating the drive transistor Trd for carrier mobility variations from pixel to pixel is subtracted from a voltage actually held by the signal holding capacitor Cs as will be described later in detail by referring to a timing T7 shown in FIG. 12. Thus, the period between the timings T5 and T6 is a period allocated to an operation to store the electric potential Vsig of the video signal in the signal holding capacitor Cs and an operation to compensate the drive transistor Trd for carrier mobility variations from pixel to pixel. In other words, when the second control pulse P2 is asserted on the scan line WS, the operation to store the electric potential Vsig of the video signal in the signal holding capacitor Cs and the operation to compensate the drive transistor Trd for carrier mobility variations from pixel to pixel are carried out. The length of the period between the timings T5 and T6 allocated to the operation to store the electric potential Vsig of the video signal in the signal holding capacitor Cs and the operation to compensate the drive transistor Trd for carrier mobility variations from pixel to pixel is equal to the width of the second control pulse P2. That is to say, the width of the second control pulse P2 prescribes the period allocated to the operation to store the electric potential Vsig of the video signal in the signal holding capacitor Cs and the operation to compensate the drive transistor Trd for carrier mobility variations from pixel to pixel.

As described above, the operation to store the electric potential Vsig of the video signal in the signal holding capacitor Cs and the operation to compensate the drive transistor Trd for carrier mobility variations by adjusting the compensation quantity which is the voltage difference ΔV are carried out in the period between the timings T5 and T6. The higher the electric potential Vsig of the video signal, the larger the drain-source current Ids supplied by the drive transistor Trd and, hence, the larger the absolute value of the compensation quantity ΔV becomes. Thus, the pixel circuit 2 carries out an operation to compensate the drive transistor Trd for carrier mobility variations in accordance with the luminance level of light emitted by the light emitting device EL. For a fixed electric potential Vsig of the video signal, the larger the mobility μ of the drive transistor Trd becomes, the larger the absolute value of the compensation quantity ΔV. In other words, the larger the mobility μ of the drive transistor Trd, the larger the negative feedback quantity ΔV fed back to the signal holding capacitor Cs. Thus, variations of the mobility μ from pixel to pixel can be eliminated.

With the timing T6, the second control pulse P2 is removed to change the electric potential on the scan line WS from a high level to a low level so as to put sampling transistor Tr1 in a turned-off state. Thus, the gate electrode G of the drive transistor Trd is put in a floating state of electrically disconnecting the gate electrode G of the drive transistor Trd from the signal line SL. At that time, the driving current Ids starts flowing from the drive transistor Trd to the light emitting device EL. Thus, the electric potential on the anode electrode of the light emitting device EL rises in accordance with the driving current Ids. The increase of the electric potential on the anode electrode of the light emitting device EL is neither more nor less than the increase of the electric potential on the source electrode S of the drive transistor Trd. When the electric potential on the source electrode S of the drive transistor Trd increases, the electric potential on the gate electrode G of the drive transistor Trd also increases by the signal holding capacitor Cs in a bootstrap operation of the bootstrap function described earlier. That is to say, the increase of the electric potential on the gate electrode G of the drive transistor Trd is equal to the increase of the electric potential on the source electrode S of the drive transistor Trd. Therefore, during the light emission period, the gate-source voltage Vgs between the gate electrode G of the drive transistor Trd and the source electrode S of the drive transistor Trd is sustained at a constant value. The magnitude of the gate-source voltage Vgs is a difference between the electric potential on the gate electrode G of the drive transistor Trd and the electric potential Vsig of the video signal compensated for an effect of variations in threshold voltage Vth and variations in mobility μ from pixel to pixel. In the light emission period, the drive transistor Trd is operating in the saturated region. That is to say, the drive transistor Trd outputs the drain-source current Ids according to the gate-source voltage Vgs between the gate electrode G of the drive transistor Trd and the source electrode S of the drive transistor Trd, and the magnitude of the gate-source voltage Vgs is a difference between the electric potential on the gate electrode G of the drive transistor Trd and the electric potential Vsig of the video signal compensated for an effect of variations in threshold voltage Vth and an effect variations in mobility μ from pixels to pixels as described above.

Figure 4:
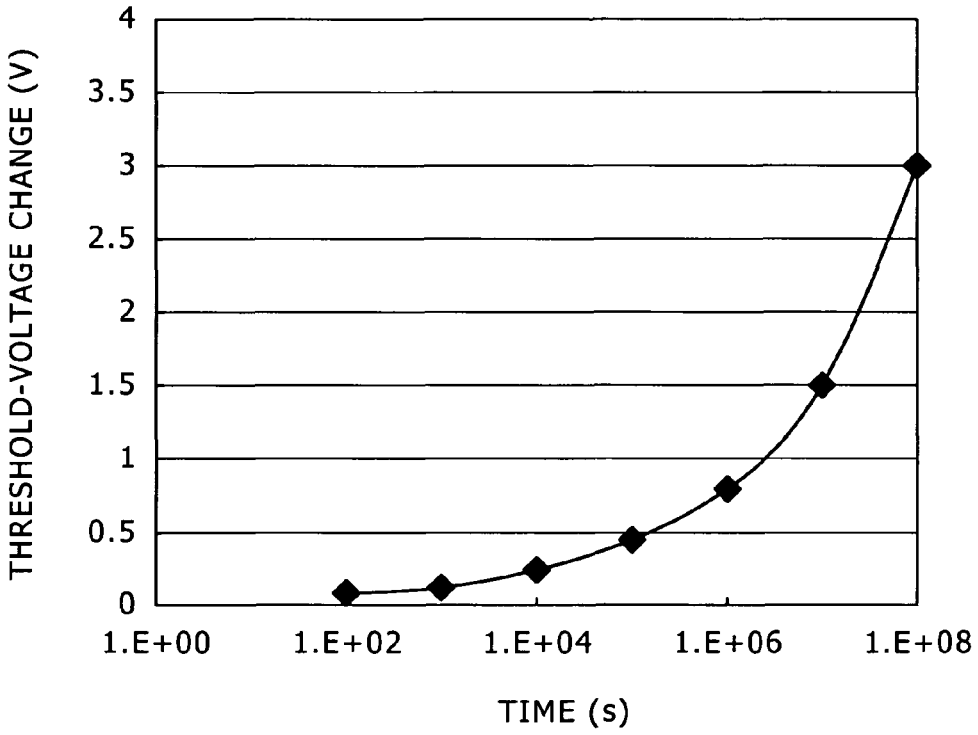
FIG. 4 is a diagram showing a graph representing the relation between the variation of the threshold voltage Vth of a drive transistor of the N-channel type and the lapse of time.

In the sequence of operations carried out by the typical example of a previously developed display apparatus, most of the period of one field (1f) is used as the light emission period whereas the remaining short period of one field (1f) is used as the no-light emission period. As described above, in the short no-light emission period, the pixel circuit 2 carries out a threshold-voltage compensation operation and a signal write operation. If the drive transistor Trd is a TFT made in a thin-film process making use of non-crystalline silicon, the threshold-voltage characteristic of the drive transistor Trd tends to be shifted by a displacement proportional to the length of the light emission period. FIG. 4 is a diagram showing a graph representing the relation between the variation of the threshold voltage Vth of a drive transistor Trd of the N-channel type and the lapse of time. The horizontal axis of the diagram represents the lapse of time whereas the vertical axis represents the change of the threshold voltage Vth. As is obvious from the graph, with the lapse of time, the threshold voltage Vth changes in the positive direction. That is to say, threshold-voltage characteristic changes in proportion to the ON time and/or the ON current of the transistor. This phenomenon is a problem inherent in a TFT device. As described above, the pixel circuit 2 in the typical example of a previously developed display apparatus has a built-in threshold-voltage compensation function to be executed to take a countermeasure against inherent variations in threshold voltage from pixel to pixel. As the magnitude of the change of threshold-voltage characteristic with the lapse of time increases, however, the large change of threshold-voltage characteristic with the lapse of time can no longer be handled by execution of the built-in threshold-voltage compensation function. That is to say, in order to handle the large change of threshold-voltage characteristic with the lapse of time, it is necessary to increase the power of the built-in threshold-voltage compensation function by setting the amplitude (Vcc−Vss2) of the power-supply voltage and/or the amplitude (Vsig−Vss1) of the video signal at large values. With such a countermeasure taken against the large change of threshold-voltage characteristic with the lapse of time, however, the power consumption of the display panel inevitably increases.

Figure 5:
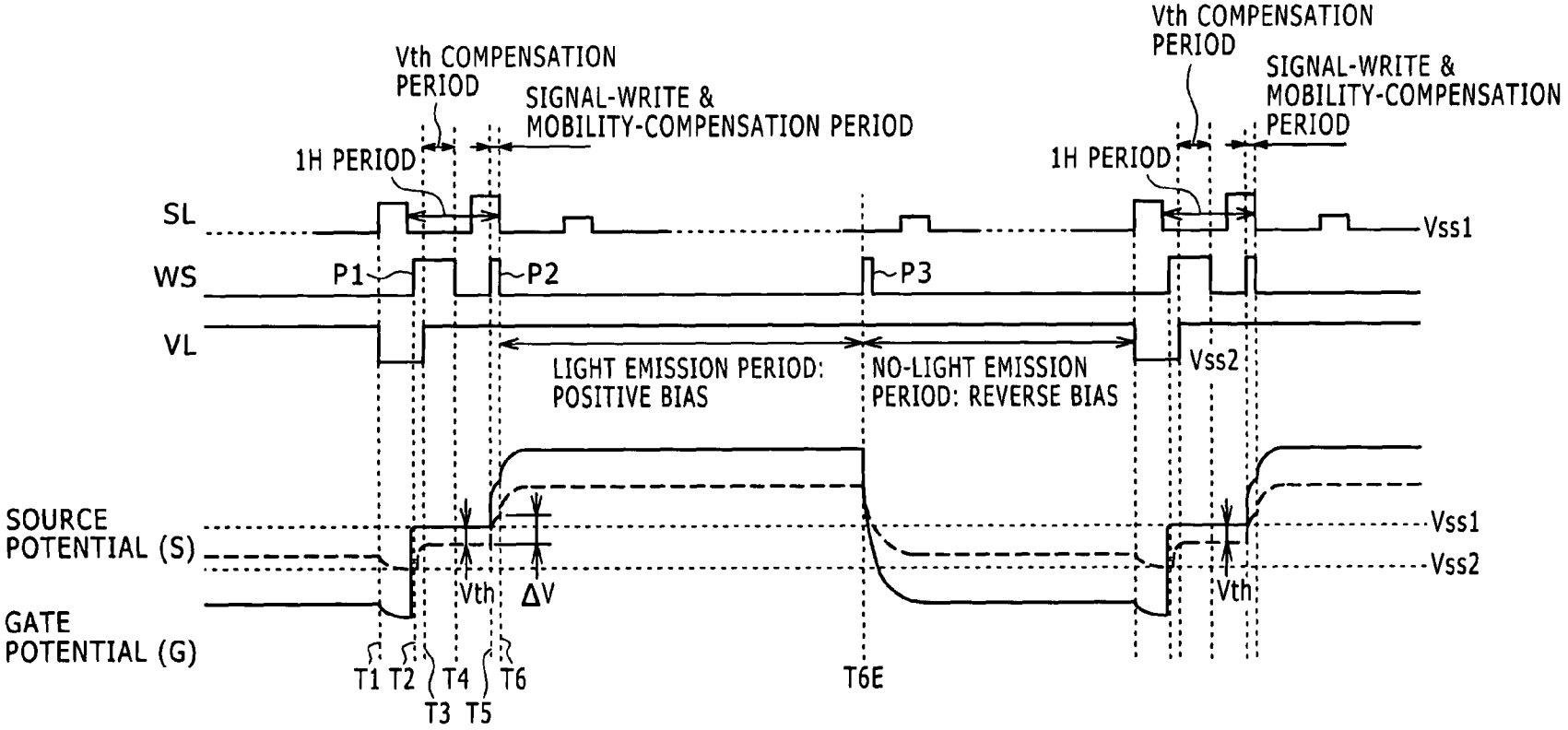
FIG. 5 is a timing diagram showing timing charts to be referred to in explanation of a sequence of operations carried out by the pixel circuit 2, which is shown in the diagrams of FIGS. 1 and 2 as a pixel circuit 2 employed in the image display apparatus provided by an embodiment of the present invention.

FIG. 5 is a timing diagram showing timing charts referred to in explanation of a sequence of operations carried out by the pixel circuit 2 employed in the image display apparatus provided by an embodiment of the present invention to take a countermeasure against the drift of the threshold voltage Vth of the drive transistor Trd with the lapse of time. As described above, the drift of the threshold voltage Vth of the drive transistor Trd with the lapse of time is a problem raised by the typical example of a previously developed display apparatus. The timing diagram of FIG. 5 is referred to in explanation of the countermeasure against this problem. In order to make the explanation easy to understand, the same reference notations as those used in FIG. 3 are also used in FIG. 5 to denote things identical with their respective counterparts shown in FIG. 3. The timing diagram of FIG. 5 is different from the timing diagram of FIG. 3 in that, with a proper timing T6E between the timing T6 at the beginning of the light emission period and the end of the field, the light emission period is forcibly terminated to start the no-light emission period. In order to terminate the light emission period forcibly and start the no-light emission period, the write scanner 4 asserts a third control pulse P3 on the scan line WS with the timing T6E. In accordance with an embodiment of the present invention, in order to terminate the light emission period forcibly and start the no-light emission period, the write scanner 4 asserts a third control pulse P3 on the scan line WS with the timing T6E, putting the sampling transistor Tr1 in a turned-on state of applying the predetermined reference potential Vss1 to the gate electrode G of the drive transistor Trd instantaneously before putting the sampling transistor Tr1 back in a turned-off state again by removing the third control pulse P3 in order to cut off the predetermined reference potential Vss1 from the gate electrode G. In accordance with an embodiment of the present invention, by applying the predetermined reference potential Vss1 to the gate electrode G of the drive transistor Trd instantaneously, the gate-source voltage Vgs applied between the gate electrode G of the drive transistor Trd and the source electrode S of the drive transistor Trd can be put in a state of a reverse bias and the drain-source current Ids flowing through the drive transistor Trd can thus be cut off. In the light emission period, on the other hand, the gate-source voltage Vgs applied between the gate electrode G of the drive transistor Trd and the source electrode S of the drive transistor Trd is in a state of a positive bias. The direction of the change of the threshold voltage Vth in the state of a reverse bias is opposite to the direction of the change of the threshold voltage Vth in the state of a positive bias. Thus, the drifts of the threshold voltage Vth can be repressed as a whole. Particularly, in accordance with an embodiment of the present invention, the magnitude of the reverse bias is adjusted automatically in accordance with the level of the electric potential Vsig of the video signal so that the drifts of the threshold voltage Vth can be eliminated completely. In particular, when the video signal is set at a white level, the voltage applied between the gate electrode G of the drive transistor Trd and the source electrode S of the drive transistor Trd is put in a state of a maximum reverse bias. When the video signal is set at a black level, however, the voltage applied between the gate electrode G of the drive transistor Trd and the source electrode S of the drive transistor Trd of the drive transistor Trd becomes a zero level or an extremely small value close to the zero level, entering a state of a minimum reverse bias the magnitude of which is determined by the optimally predetermined reference potential Vss1 and the electric potential of the video signal corresponding to the white level. Thus, the drive transistor Trd can be compensated for the threshold-voltage (Vth) change that varies from gradation to gradation. In a white-level display emitting light with a large luminance requiring that a large driving current Ids be flowed through the light emitting device EL, the upward-direction change generated during the light emission period as the drift quantity of the threshold voltage Vth increases. In order to cancel this large upward-direction change generated, the magnitude of the reverse bias is automatically increased during the no-light emission period in order to secure a required downward-direction drift quantity in advance. In a black-level display emitting light with a small luminance, on the other hand, almost no upward-direction drift quantity is generated during the light emission period as the drift quantity of the threshold voltage Vth. It is thus not necessary to apply a substantial reverse bias to the drive transistor Trd during the no-light emission period.

In order to terminate the light emission period forcibly and start the no-light emission period, the write scanner 4 asserts a third control signal pulse P3 having a width of the order of several microseconds (μs) on the scan line WS with the timing T6E, putting the sampling transistor Tr1 in a turned-on state of applying the predetermined reference potential Vss1 to the gate electrode G of the drive transistor Trd instantaneously by sustaining the electric potential on the source electrode S of the drive transistor Trd at an approximately fixed level. With the timing T6E, the electric potential on the gate electrode G of the drive transistor Trd thus instantaneously decreases to the predetermined reference potential Vss1. Since the electric potential on the source electrode S of the drive transistor Trd is sustained at an approximately fixed level, the operation to decrease the electric potential on the gate electrode G of the drive transistor Trd to the predetermined reference potential Vss1 reverses the electric potential on the gate electrode G of the drive transistor Trd with respect to the electric potential on the source electrode S of the drive transistor Trd, putting the gate-source voltage Vgs applied between the gate electrode G of the drive transistor Trd and the source electrode S of the drive transistor Trd in a state of a reverse bias. In this state of a reverse bias, the drive transistor Trd is put in a turned-off state so that the driving current Ids flowing through the drive transistor Trd is cut off. Since the driving current Ids is not flowing through the drive transistor Trd, the electric potential on the source electrode S of the drive transistor Trd also decreases as well. After the third control pulse P3 is removed, the sampling transistor Tr1 is put in a turned-off state and the gate electrode G of the drive transistor Trd is thus electrically disconnected from the signal line SL and put in a floating state which causes the electric potential on the gate electrode G of the drive transistor Trd to follow the electric potential on the source electrode S due to the bootstrap effect. As a result, the electric potential on the gate electrode G of the drive transistor Trd further decreases, sustaining the difference between the gate-source voltage Vgs applied between the gate electrode G of the drive transistor Trd and the source electrode S of the drive transistor Trd at a constant magnitude equal to the reverse bias.

As shown in FIG. 5, during the light emission period, the higher the electric potential Vsig of the video signal at which the electric potential on the gate electrode G of the drive transistor Trd is set, the larger the difference between the electric potential on the gate electrode G of the drive transistor Trd and the electric potential on the source electrode S of the drive transistor Trd and, hence, the larger the magnitude of the positive bias. As described above, since the electric potential on the source electrode S of the drive transistor Trd is sustained at an approximately fixed level, with the timing T6E, the operation to decrease the electric potential on the gate electrode G of the drive transistor Trd to the predetermined reference potential Vss1 reverses the electric potential on the gate electrode G of the drive transistor Trd with respect to the electric potential on the source electrode S of the drive transistor Trd, putting the gate-source voltage Vgs applied between the gate electrode G of the drive transistor Trd and the source electrode S of the drive transistor Trd in a state of a reverse bias. As is obvious from the changes generated with the timing T6E in FIG. 5, the larger the magnitude of the positive bias, the larger the magnitude of the reverse bias. However, the magnitude of the positive bias is not always completely proportional to the magnitude of the reverse bias. In some cases, the phase of the third control signal pulse P3 applied to the scan line WS needs to be adjusted to optimize the ratio of the length of the light emission period to the length of the no-light emission period. At an optimal ratio, an upward threshold-voltage change (or an increase) caused by the state of a positive bias (that is, the state of a positive bias) during the light emission period as a threshold-voltage change of the drive transistor Trd can be canceled by making use of a downward threshold-voltage change (or a decrease) caused by the state of a reverse bias (that is, the state of a negative bias) during the no-light emission period as a threshold-voltage change of the drive transistor Trd.

Figure 6:
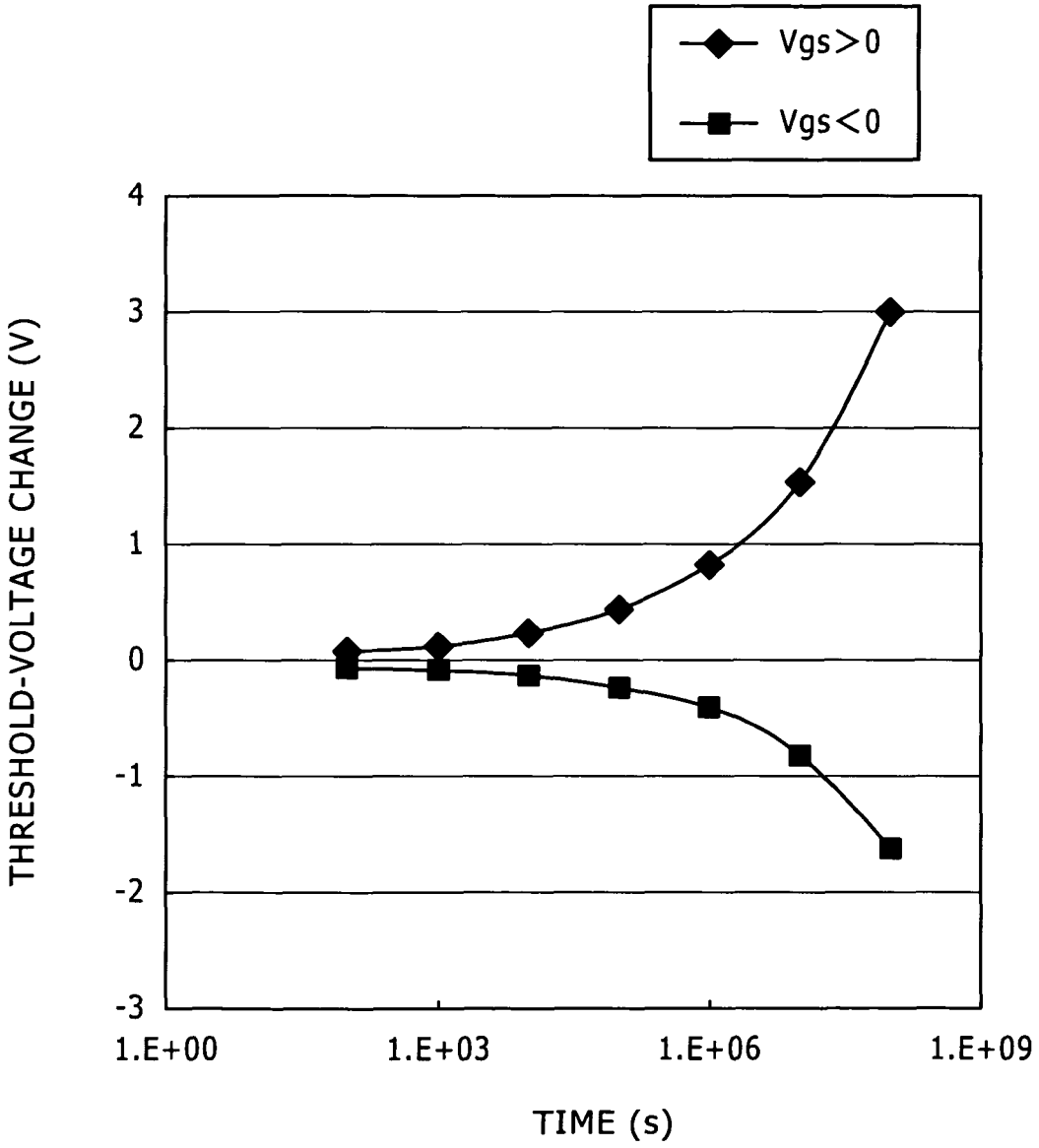
FIG. 6 is a diagram showing graphs each representing the relation between the variation of the threshold voltage Vth of a transistor drive of the N-channel type and the lapse of time.

FIG. 6 is a diagram showing graphs each representing the relation between the variation of the threshold voltage Vth of a drive transistor Trd and the lapse of time. The horizontal axis of the diagram represents the lapse of time whereas the vertical axis represents the change of the threshold voltage Vth. As is obvious from the graph, with the lapse of time, the threshold voltage Vth changes in the positive (upward) direction for a positive bias applied between the gate electrode G of the drive transistor Trd and the source electrode S of the same transistor (that is, Vgs>0) but the threshold voltage Vth conversely changes in the negative (downward) direction for a negative bias applied between the gate electrode G of the drive transistor Trd and the source electrode S of the same transistor (that is, Vgs<0). That is to say, since a positive bias is applied between the gate electrode G of the drive transistor Trd and the source electrode S of the same transistor during the light emission period, the threshold voltage Vth changes in the positive direction. In order to cope with the change in the positive direction, in accordance with an embodiment of the present invention, a negative bias is applied between the gate electrode G of the drive transistor Trd and the source electrode S of the same transistor during the no-light emission period so as to change the threshold voltage Vth in the negative direction. Since the change in the positive direction and the change in the negative direction kill each other, as a whole, the change in threshold voltage Vth with the lapse of time can be substantially reduced. Thus, the threshold-voltage compensation function built in the pixel circuit 2 can be executed effectively and it is not necessary to increase the amplitude of the power-supply voltage in order to enhance the power of the threshold-voltage compensation function.

Figure 7A:
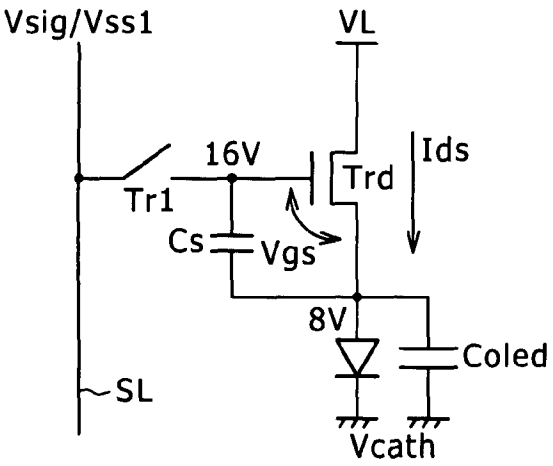
FIGS. 7A to 7C are a plurality of model diagrams each referred to in explanation of the operation of the pixel circuit 2 provided by an embodiment of the present invention in the case of a white level.
Figure 7B:
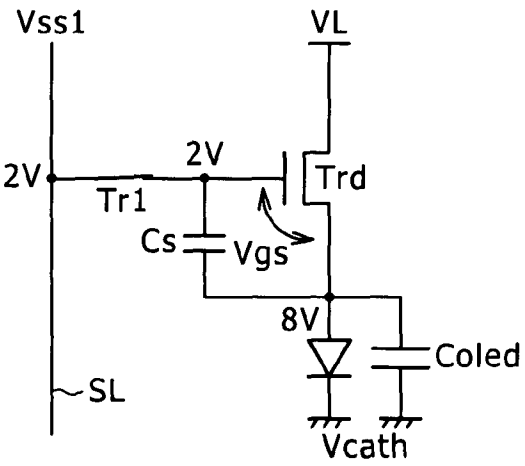
Figure 7C:
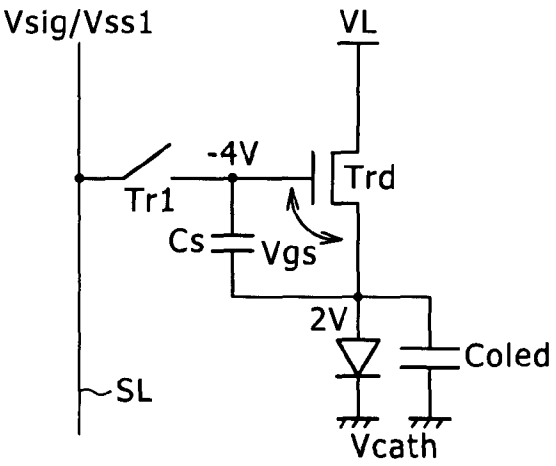

FIG. 7 is a plurality of model diagrams each referred to in explanation of the operation of the pixel circuit 2 provided by an embodiment of the present invention. In particular, the model diagrams of FIG. 7 show a case in which the electric potential Vsig of the video signal is set at the white level. To be more specific, FIG. 7A is a model diagram showing an operating state in the light transmission period with a positive bias. FIG. 7B is a model diagram showing the state of the pixel circuit 2 at the time the drain-source current Ids flowing through the drive transistor Trd is cut off. FIG. 7C is a model diagram showing an operating state in the no-light transmission period with the reverse bias. As described above, in accordance with an embodiment of the present invention, when an electric potential determined in advance (that is, the predetermined reference potential Vss1) is applied to the gate electrode G of the drive transistor Trd at a time in the light emission period, the drain-source current Ids flowing through the drive transistor Trd is cut off to terminate the light emission period, commencing the no-light emission period. In the light emission period shown in the model diagram of FIG. 7A as a light emission period for a white-level display, the electric potential on the source electrode S of the drive transistor Trd (that is, the electric potential on the anode electrode of the light emitting device EL) is an electric potential corresponding to a driving current Ids for generating light with the highest luminance. The electric potential on the source electrode S of the drive transistor Trd has a value in the range 5 to 10V, depending on the absolute value of the luminance and an aperture ratio. In the typical example shown in FIG. 7A, the electric potential on the source electrode S of the drive transistor Trd is set at a typical value of 8V. On the other hand, the maximum magnitude of the electric potential Vsig of the video signal is set at 16V and applied to the gate electrode G of the drive transistor Trd. Thus, in the case of a white-level display, the gate-source voltage Vgs serving as the positive bias is 8V.

In the operating state shown in FIG. 7B, the sampling transistor Tr1 is put in a turned-on state of applying the predetermined reference potential Vss1 of 2V to the gate electrode G of the drive transistor Trd. Since the electric potential on the source electrode S of the drive transistor Trd is sustained at a typical level of about 8V as will be described below, a reverse of −6V is applied between the gate electrode G of the drive transistor Trd and the source electrode S of the drive transistor Trd, putting the drive transistor Trd in a turned-off state that cuts off the drain-source current Ids flowing through the drive transistor Trd. The time it takes to apply the predetermined reference potential Vss1 to the gate electrode G of the drive transistor Trd and store the predetermined reference potential Vss1 in the signal holding capacitor Cs is a short time period having a length of several microseconds (μs). At the end of this time period, almost no leak current is flowing through the light emitting device EL which has also been put in a turned-off state of cutting off the drain-source current Ids flowing through the light emitting device EL. Thus, the electric potential on the source electrode S of the drive transistor Trd (that is, the electric potential on the anode electrode of the light emitting device EL) almost does not change, being sustained at the level of 8V. As a result, a reverse bias of −6V is applied between the gate electrode G of the drive transistor Trd and the source electrode S of the drive transistor Trd as described above.

The model diagram of FIG. 7C shows an operating state which the pixel circuit 2 enters after both the drive transistor Trd and the light emitting device EL have been put in a turned-off state of cutting off the drain-source current Ids flowing through the drive transistor Trd and the light emitting device EL. In this turned-off state prevailing during the no-light emission period, the electric potential on the source electrode S of the drive transistor Trd (that is the electric potential on the anode electrode of the light emitting device EL) is decreasing toward the cathode electric potential Vcath till the electric potential on the anode electrode of the light emitting device EL reaches such a level that the leak current cited above ceases to flow through the light emitting device EL. However, the absolute value of the gate-source voltage Vgs is sustained at a fixed value due to the bootstrap function. That is to say, in the entire no-light emission period, the state of the reverse bias is kept.

Figure 8A:
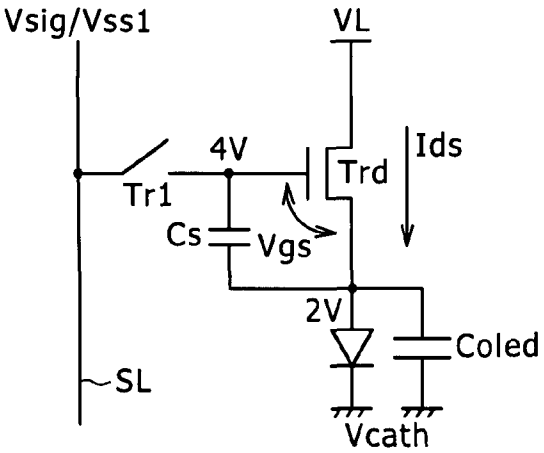
FIGS. 8A to 8C are also a plurality of model diagrams each referred to in explanation of the operation of the pixel circuit 2 provided by an embodiment of the present invention in the case of a black level.

FIG. 8 is a plurality of model diagrams identical with the model diagrams of FIG. 7. In particular, the model diagrams of FIG. 8 show a transition from the light emission period to the no-light emission period for a case in which the electric potential Vsig of the video signal is set at the black level. The same reference notations as those used in FIG. 7 are also used in FIG. 8 to denote things identical with their respective counterparts shown in FIG. 7. In the case of the black-level display, however, light is generated by the light emitting device EL at a minimum luminance during the light emission period shown in FIG. 8A and a small driving current Ids corresponding to the minimum luminance is flowing through the drive transistor Trd and the light emitting device EL. Since a small driving current Ids is flowing through the light emitting device EL, the light emitting device EL is in an almost turned-off state. In this almost turned-off state of the light emitting device EL, the electric potential on the source electrode S of the drive transistor Trd (that is, the electric potential on the anode electrode of the light emitting device EL) is typically about 2V. Since a video-signal electric potential equal to a typical value of about 4V has been appearing on the floating gate electrode G of the drive transistor Trd, the magnitude of the gate-source voltage Vgs before the drive transistor Trd is put into a turned-off state of cutting off the drain-source current Ids is typically only about 2V (=4V−2V). Thus, the characteristic of the threshold voltage Vth also almost does not change much either during the light emission period.

Figure 8B:
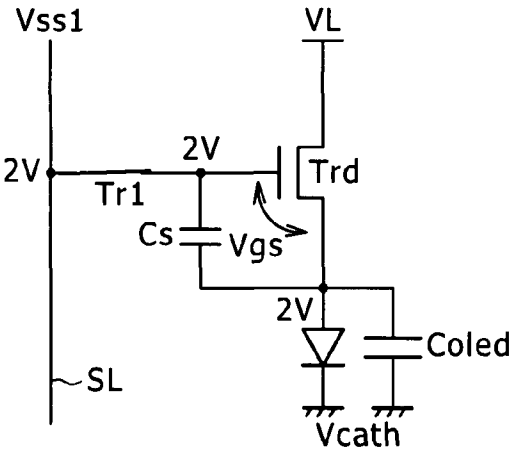
Figure 8C:
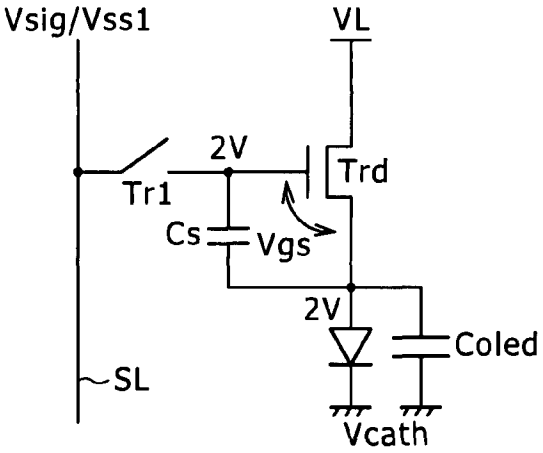

In the same way as the white-level display, as shown in FIG. 8B, the drive transistor Trd can be put into a turned-off state by applying the predetermined reference potential Vss1 of 2V to the gate electrode G of the drive transistor Trd through the sampling transistor Tr1 which is put in a turned-on state by applying the third control pulse P3. In this transition of the drive transistor Trd from a turned-on state to a turned-off state, the gate-source voltage Vgs is thus set at 0V (=2V−2V). This gate-source voltage Vgs equal to about 0V is referred to as the minimum reverse bias mentioned before. The magnitude of the gate-source voltage Vgs is sustained as it is also in the no-light emission period shown in FIG. 8C. Since the reverse bias is not applied between the gate electrode G of the drive transistor Trd and the source electrode S of the drive transistor Trd in the no-light emission period, the threshold voltage Vth also does not change in the negative direction in the no-light emission period. In the case of a black-level display, the characteristic of the threshold voltage Vth also almost does not change much either during the light emission period and the no-light emission period.

As is obvious from the sequence of operations described above, in accordance with an embodiment of the present invention, in general, a reverse bias is deliberately applied between the gate electrode G of the drive transistor Trd and the source electrode S of the drive transistor Trd in the no-light emission period in order to change the threshold voltage Vth in the downward direction. This downward-direction change made during the no-light emission period as a change of the threshold voltage Vth cancels the upward-direction change made during the light emission period as a change of the threshold voltage Vth. In this way, the threshold voltage Vth is restored to its original value. In the case of a black-level display, in particular, a reverse bias is not applied between the gate electrode G of the drive transistor Trd and the source electrode S of the drive transistor Trd in the no-light emission period so that the threshold voltage Vth does not decrease in the no-light emission period. That is to say, in the case of a black-level display, virtually, neither forward bias nor reverse bias is applied between the gate electrode G of the drive transistor Trd and the source electrode S of the drive transistor Trd and, thus, the threshold voltage Vth does not change. As a result, in accordance with an embodiment of the present invention, in the long run of the lapse of time, changes in threshold voltage Vth can be repressed considerably. Thus, since it is not necessary to strengthen the threshold-voltage compensation function built in the pixel circuit 2, it is also not necessary to increase the amplitude of the power-supply voltage so that the power consumption of the display panel can be sustained at a low value.

Figure 9:
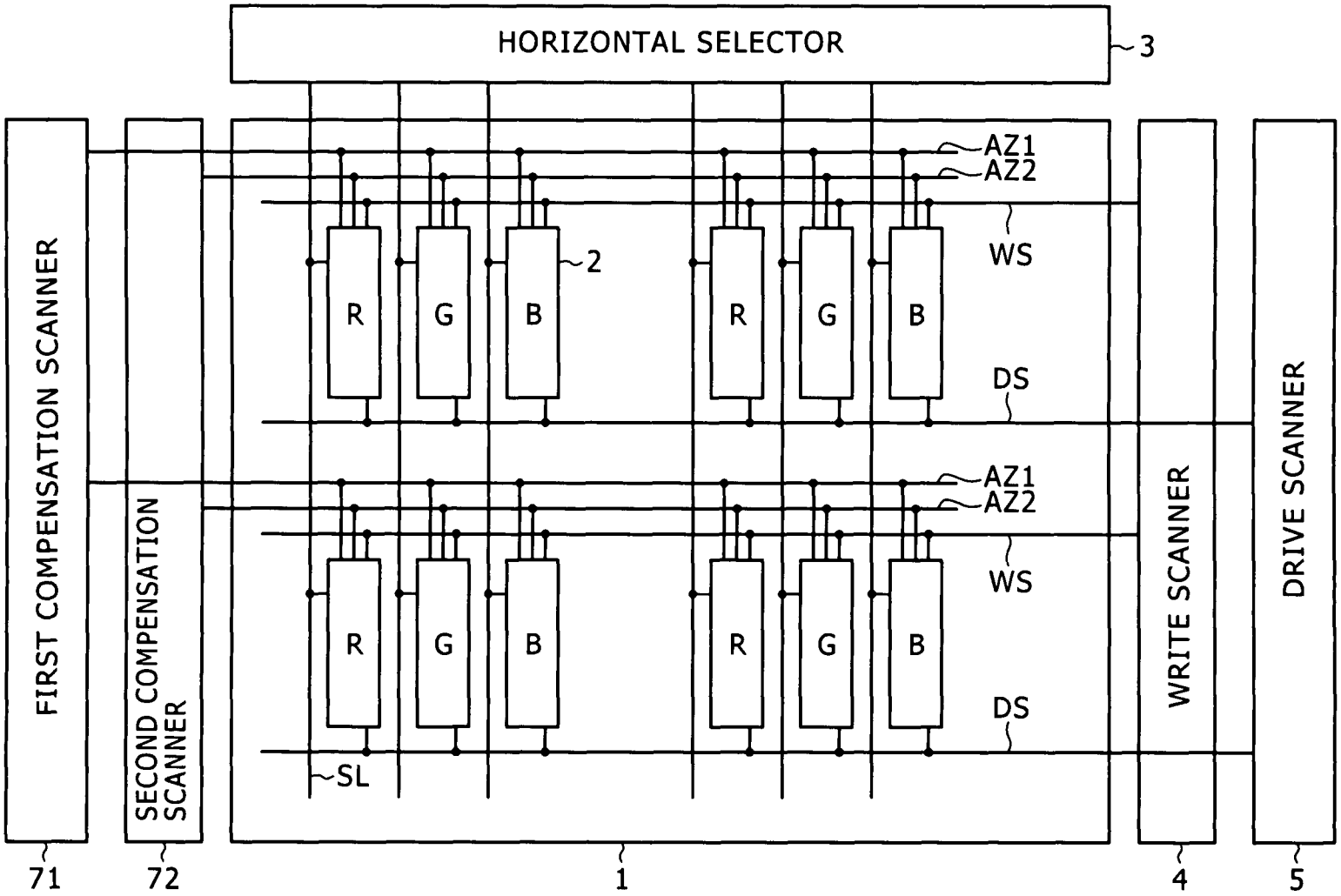
FIG. 9 is a block diagram showing the entire configuration of another embodiment implementing an image display apparatus provided by an embodiment of the present invention.

FIG. 9 is a block diagram showing the entire configuration of another embodiment implementing an image display apparatus provided by an embodiment of the present invention. As shown in FIG. 9, the image display apparatus basically employs a pixel array section 1, scanners 4, 5, 71, and 72 as well as a horizontal selector 3 serving as a signal section. The scanners 4, 5, 71, and 72 as well as the horizontal selector 3 form a driving section configured to drive the pixel array section 1. The pixel array section 1 is a matrix of pixel circuits 2. A second scan line DS connected to the drive scanner 5, a first scan line WS connected to the write scanner 4, a third scan line AZ1 connected to the first compensation scanner 71 and a fourth scan line AZ2 together form a row of the matrix. On the other hand, a signal line SL connected to the horizontal selector 3 forms a column of the matrix. Each of the matrix circuits 2 each serving as an element of the matrix is located at an intersection of such a row and such a column. That is to say, each of the matrix circuits 2 is connected to the second scan line DS, the first scan line WS, the third scan line AZ1, the fourth scan line AZ2 and the signal line SL. In addition to the second scan line DS, the first scan line WS, the third scan line AZ1, the fourth scan line AZ2 and the signal line SL, each of the matrix circuits 2 is also connected to a plurality of power-supply lines used for supplying a first reference potential Vss1, a second reference potential Vss2 and a third reference potential VDD to the pixel circuit 2.

The horizontal selector 3 serving as a signal section asserts a video signal on the signal line SL. The scanner section consisting of the scanners 4, 5, 71, and 72 asserts control signals on respectively the first scan line WS, the second scan line DS, the third scan line AZ1 and the fourth scan line AZ2 which together form a row of the matrix. The scanner section asserts the control signals on each of the rows sequentially from a row to another in order to scan the pixel circuits 2 in row units.

Figure 10:
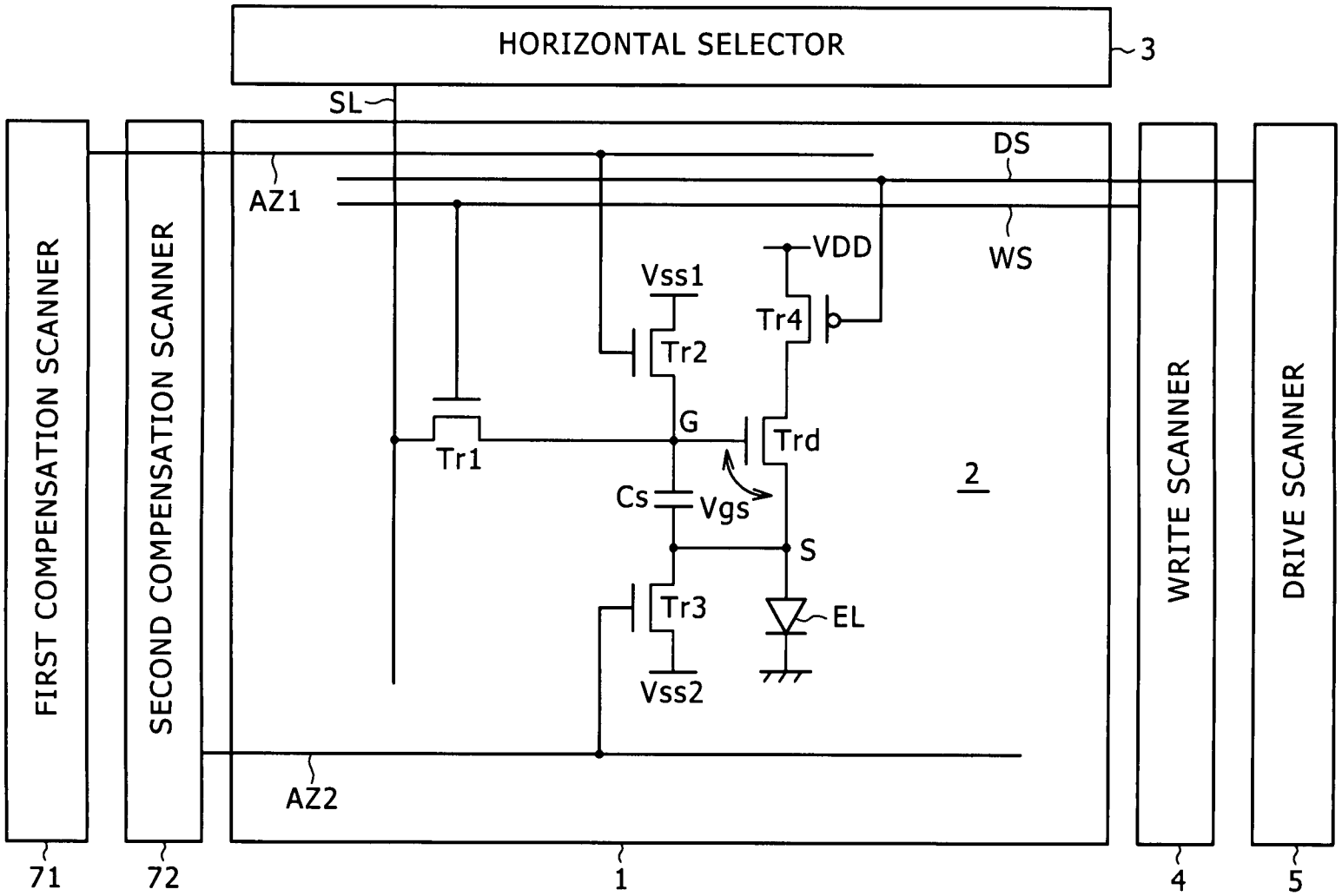
FIG. 10 is a diagram showing mainly the circuit configuration of each pixel circuit 2 employed in the image display apparatus shown in FIG. 9.

FIG. 10 is a diagram showing mainly the circuit configuration of each pixel circuit 2 employed in the image display apparatus shown in FIG. 9. As shown in FIG. 10, the pixel circuit 2 employs a sampling transistor Tr1, a drive transistor Trd, a first switching transistor Tr2, a second switching transistor Tr3, a third switching transistor Tr4, a signal holding capacitor Cs and a light emitting device EL. The sampling transistor Tr1 is put in a turned-on state by a control signal applied to the gate electrode of the sampling transistor Tr1 by the write scanner 4 through the first scan line WS for a sampling period determined in advance to serve as a video-signal write period, sampling the electric potential of a video signal asserted by the horizontal selector 3 on the signal line SL and stores the sampled electric potential of the video signal in the signal holding capacitor Cs. The signal holding capacitor Cs applies a gate-source voltage Vgs having an electric potential equal to the stored electric potential of the video signal to the gate electrode G of the drive transistor Trd. The drive transistor Trd supplies a driving current Ids corresponding to the gate-source voltage Vgs to the light emitting device EL. During a light emission period determined in advance, the light emitting device EL emits light with a luminance according to the drain-source current Ids received from the drive transistor Trd as a current corresponding to the gate-source voltage Vgs having an electric potential equal to the stored electric potential of the video signal.

The first switching transistor Tr2 is put in a turned-on state by a control signal applied to the gate electrode of the first switching transistor Tr2 by the first compensation scanner 71 through the third scan line AZ1 prior to the sampling period which is also referred to as a video-signal write period as described above. In this turned-on state, the first switching transistor Tr2 applies the first reference potential Vss1 to the gate electrode G of the drive transistor Trd. The gate electrode G of the drive transistor Trd is the control terminal of the drive transistor Trd as described above. By the same token, the second switching transistor Tr3 is put in a turned-on state by a control signal applied to the gate electrode of the second switching transistor Tr3 by the second compensation scanner 72 through the fourth scan line AZ2 prior to the sampling period. In this turned-on state, the second switching transistor Tr3 applies the second reference potential Vss2 to the source electrode S of the drive transistor Trd. The source electrode S of the drive transistor Trd is one of the two current terminals of the drive transistor Trd. In the same way, the third switching transistor Tr4 is put in a turned-on state by a control signal applied to the gate electrode of the third switching transistor Tr4 by the drive scanner 5 through the second scan line DS prior to the sampling period. In this turned-on state, the third switching transistor Tr4 applies the third reference potential VDD to the drain electrode D of the drive transistor Trd. The drain electrode D of the drive transistor Trd is the other current terminal of the drive transistor Trd. Thus, the first reference potential Vss1 is applied to the gate electrode G of the drive transistor Trd whereas the second reference potential Vss2 lower than the first reference potential Vss1 is applied to the source electrode S of the drive transistor Trd, putting the drive transistor Trd in a turned-on state raising the electric potential on the source electrode S during a period between the timings T3 and T4 shown in FIG. 12 in the same way as the period between the timings T3 and T4 shown in FIG. 3 described before prior to the sampling period, so that a gate-source voltage Vgs equal to the threshold voltage Vth of the drive transistor Trd is stored in the signal holding capacitor Cs in order to compensate the drive transistor Trd for an effect of variations in threshold voltage Vth from pixel to pixel. In addition, the third switching transistor Tr4 is again put in a turned-on state by a control signal applied to the gate electrode of the third switching transistor Tr4 by the drive scanner 5 through the second scan line DS during the light emission period in order to apply the third reference potential VDD to the drain electrode D of the drive transistor Trd so that, this time, the drain-source current Ids flows to the light emitting device EL.

As described above, the pixel circuit 2 employs five transistors, i.e., the sampling transistor Tr1, the drive transistor Trd, the first switching transistor Tr2, the second switching transistor Tr3 and the third switching transistor Tr4, as well as the signal holding capacitor Cs and the light emitting device EL. Each of the sampling transistor Tr1, the drive transistor Trd, the first switching transistor Tr2 and the second switching transistor Tr3 is a poly-silicon TFT of the N-channel type. Only the third switching transistor Tr4 is a poly-silicon TFT of the P-channel type. However, the present invention is by no means limited to this configuration of the pixel circuit 2. That is to say, the mixture of the types of the transistors can be properly changed. The light emitting device EL is typically an organic EL device provided with anode and cathode electrodes. That is to say, the pixel circuit provided by an embodiment of present invention can employ any ordinary light emitting device as long as the light emitting device is driven by a current to emit light.

Figure 11:
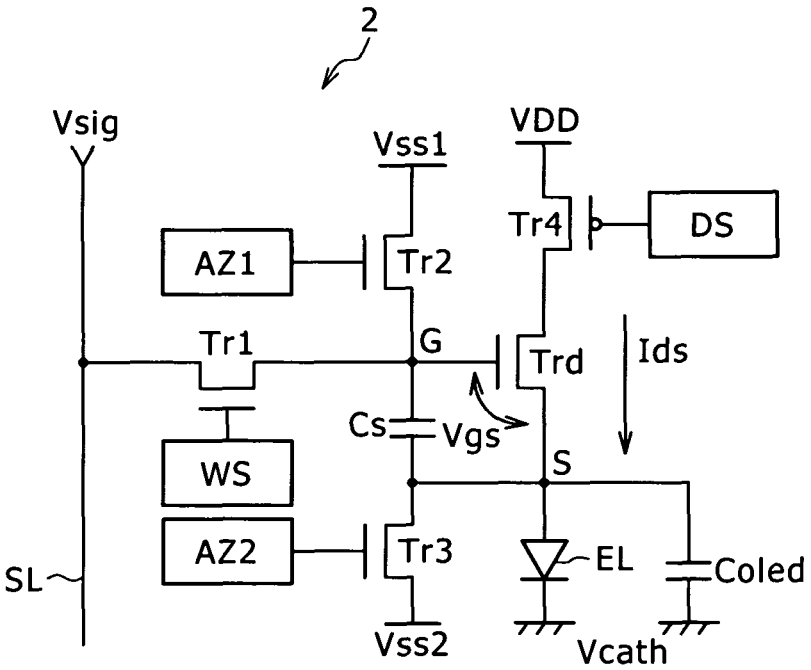
FIG. 11 is a circuit diagram showing the configuration of the pixel circuit 2 employed in the image display apparatus shown in the diagram of FIG. 10.

FIG. 11 is a circuit diagram showing the configuration of only the pixel circuit 2 employed in the image display apparatus shown in FIG. 10. In order to make the explanation easy to understand, the electric potential Vsig of the video signal sampled by the sampling transistor Tr1, the gate-source voltage Vgs supplied to the drive transistor Trd, the driving current Ids generated by the drive transistor Trd and a capacitive component Coled of the light emitting device EL are added to the configuration of the pixel circuit 2.

Figure 12:
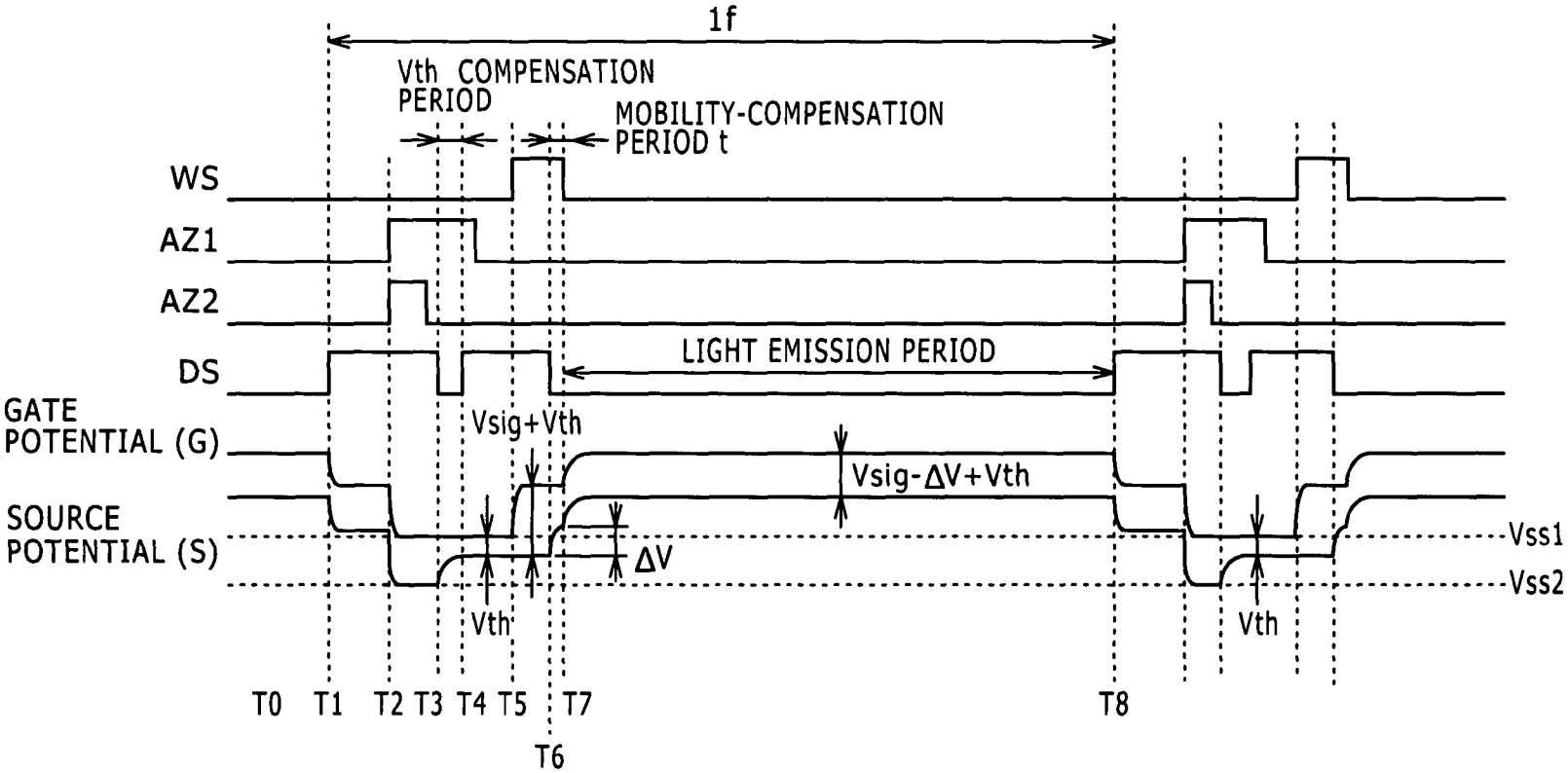
FIG. 12 is a timing diagram showing timing charts for the pixel circuit 2 shown in the diagrams of FIGS. 9 to 11.

FIG. 12 is a timing diagram showing timing charts for the pixel circuit 2 shown in FIG. 11. However, the timing charts represent a sequence of operations which do not include an operation to carry out a countermeasure against drifts of the threshold voltage Vth of the drive transistor Trd in accordance with an embodiment of the present invention. In order to make the explanation of the present invention easy to understand, the sequence of operations represented by the timing diagram of FIG. 12 is explained first as a part of operations including an operation to carry out a countermeasure against drifts of the threshold voltage Vth of the drive transistor Trd in accordance with the an embodiment of present invention. The timing diagram of FIG. 12 shows the waveforms of the control signals asserted on the first scan line WS, the second scan line DS, the third scan line AZ1 and the fourth scan line AZ2 as well as the electric potentials on the gate electrode G of the drive transistor Trd and the source electrode S of the drive transistor Trd. In order to make the timing diagram simple, in the timing diagram, a control signal asserted on a line is denoted by the same reference notation as the line whereas an electric potential on an electrode of the drive transistor Trd is denoted by the same reference notation as the electrode. Since each of the sampling transistor Tr1, first switching transistor Tr2 and the second switching transistor Tr3 is a TFT of the N-channel type, the sampling transistor Tr1, first switching transistor Tr2 or the second switching transistor Tr3 is put in a turned-on or turned-off state when the first scan line WS connected to the sampling transistor Tr1, the third scan line AZ1 connected to the first switching transistor Tr2 or the fourth scan line AZ2 connected to the second switching transistor Tr3 is raised to a high level or pulled down to a low level respectively. Since the third switching transistor Tr4 is a TFT of the P-channel type, on the other hand, the third switching transistor Tr4 is put in a turned-on or turned-off state when the second scan line DS connected to the third switching transistor Tr4 is pulled down to a low level or raised to a high level respectively. By the same token, since the drive transistor Trd is a TFT of the N-channel type, the drive transistor Trd is put in a turned-on or turned-off state when the gate-source voltage Vgs applied between the gate electrode G of the drive transistor Trd and the source electrode S of the drive transistor Trd is a forward bias or a reverse bias. The forward bias is a gate-source voltage Vgs providing an electric potential on the gate electrode G higher than an electric potential on the source electrode S whereas the reverse bias is a gate-source voltage Vgs providing an electric potential on the gate electrode G lower than an electric potential on the source electrode S.

In FIG. 12, the period between the timings T1 and T8 is the period of one field (1f). In the period of one field, rows of the pixel array section 1 are scanned sequentially once. The timing diagram of FIG. 12 shows the waveforms of the control signals asserted on the first scan line WS, the second scan line DS, the third scan line AZ1 and the fourth scan line AZ2 in the period of one field as well as the electric potentials on the gate electrode G of the drive transistor Trd and the source electrode S of the drive transistor Trd in the same period of one field.

With a timing T0 before the field starts with a timing T1, each of the first scan line WS, the third scan line AZ1, the fourth scan line AZ2 and the second scan line DS is at a low level so that the sampling transistor Tr1 of the N-channel type, the first switching transistor Tr2 of the N-channel type and the second switching transistor Tr3 of the N-channel type is in a turned-off state but only the third switching transistor Tr4 of the P-channel type is in a turned-on state. With the third switching transistor Tr4 put in a turned-on state, the drive transistor Trd is connected to the third reference potential VDD by the third switching transistor Tr4, providing the light emitting device EL with a drain-source current Ids according to a predetermined gate-source voltage Vgs, which is set at a forward bias setting the drive transistor Trd in a turned-on state. The drain-source current Ids drives the light emitting device EL to emit light during a light emission period including a point of time corresponding to the timing T0. As is obvious from the description given before, the gate-source voltage Vgs applied between the gate electrode G of the drive transistor Trd and the source electrode S of the drive transistor Trd is a difference in electric potential between the gate electrode G and the source electrode S.

With the timing T1 to start the field, the control signal asserted on the second scan line DS changes from a low level to a high level, putting the third switching transistor Tr4 in a turned-off state. Thus, the drive transistor Trd is electrically disconnected from the third reference potential VDD. As a result, the light emission period is ended whereas a no-light emission period is commenced. In the early part of the no-light emission period following this timing T1, all the sampling transistor Tr1, the first switching transistor Tr2, the second switching transistor Tr3 and the third switching transistor Tr4 are in a turned-off state.

With a timing T2, each of the control signals asserted on the third scan line AZ1 and the fourth scan line AZ2 is raised to a high level, putting respectively the first switching transistor Tr2 and the second switching transistor Tr3 in a turned-on state. Thus, the first reference potential Vss1 is applied to the gate electrode G of the drive transistor Trd whereas the second reference potential Vss2 is applied to the source electrode S of the drive transistor Trd. In this case, the first reference potential Vss1 and the second reference potential Vss2 satisfy the relation Vss1−Vss2>Vth where reference notation Vth denotes the threshold voltage of the drive transistor Trd. This operation to set the gate-source voltage Vgs (=Vss1−Vss2) at a level higher than the threshold voltage Vth is an operation preparing the pixel circuit 2 for a threshold-voltage compensation operation to be carried out with a timing T3. In other words, a period between the timings T2 and T3 is a period corresponding to a preparatory period which is a reset period of the drive transistor Trd. In addition, the second reference potential Vss2 is set at a level satisfying the relation VthEL>Vss2 where reference notation VthEL denotes the threshold voltage of the light emitting device EL. Thus, a minus (negative) bias is applied to the light emitting device EL, putting the light emitting device EL in the so-called reverse bias state. This state of a reverse bias is required for normally carrying out a Vth (threshold-voltage) compensation operation and a mobility compensation operation later on as described below.

With the timing T3, each of the control signals asserted on the fourth scan line AZ2 and the second scan line DS is changed to a low level. Thus, the second switching transistor Tr3 is put in a turned-off state but the third switching transistor Tr4 is put in a turned-on state. As a result, the driving current Ids flows to the signal holding capacitor Cs, starting the Vth (threshold-voltage) compensation operation. At that time, the gate electrode G of the drive transistor Trd is set at the fixed first reference potential Vss1. As the difference in electric potential between the gate electrode G of the drive transistor Trd and the source electrode S of the drive transistor Trd becomes equal to the threshold voltage Vth of the drive transistor Trd, the drive transistor Trd is put in a turned-off state that cuts off the current Ids. When the drive transistor Trd is put in a turned-off state of cutting of the current Ids, the electric potential at the source electrode S of the drive transistor Trd is equal to Vss1−Vth. With a timing T4 after the driving current Ids has been cut off, the control signal asserted on the second scan line DS is again changed back to a high level in order to put the third switching transistor Tr4 in a turned-off state and, later on, the control signal asserted on the third scan line AZ1 is changed back to a low level in order to put the first switching transistor Tr2 also in a turned-off state. As a result, the voltage stored in the signal holding capacitor Cs is fixed at a magnitude equal to the threshold voltage Vth of the drive transistor Trd. In this way, during a period between the timings T3 and T4, the threshold voltage Vth of the drive transistor Trd is detected and a voltage corresponding to the threshold voltage Vth is stored in the signal holding capacitor Cs. For this reason, the period between the timings T3 and T4 is referred to as the period of the Vth (threshold-voltage) compensation operation.

With a timing T5 lagging behind the Vth (threshold-voltage) compensation operation, the control signal asserted on the first scan line WS is changed to a high level in order to put the sampling transistor Tr1 in a turned-on state for sampling and storing the electric potential Vsig of the video signal in the signal holding capacitor Cs. In comparison with the equivalent capacitance Coled of the light emitting device EL, the capacitance of the signal holding capacitor Cs is sufficiently small. Thus, most of the electric potential Vsig of the video signal is stored in the signal holding capacitor Cs. To put it accurately, a difference of (Vsig−Vss1) is stored in the signal holding capacitor Cs. Thus, the gate-source voltage Vgs between the gate electrode G of the drive transistor Trd and the source electrode S of the drive transistor Trd has a magnitude equal to (Vsig−Vss1+Vth) which is the sum of the difference of (Vsig−Vss1) stored in the signal holding capacitor Cs with the timing T5 and the threshold voltage Vth representing a voltage detected and stored during the Vth (threshold-voltage) compensation period between the timings T3 and T4. In order to make the explanation easy to understand, the first reference potential Vss1 is assumed to be 0V (Vss1=0V). In this case, the magnitude of the gate-source voltage Vgs becomes equal to the value of the expression (Vsig+Vth). The operation to sample the electric potential Vsig of the video signal is continued and ended with a timing T7 with which the control signal asserted on the first scan line WS is restored to a low level. That is to say, the period between the timings T5 and T7 is a signal sampling period or a video-signal storing period.

With a timing T6 leading ahead of a timing T7 with which the video-signal sampling period is terminated, the control signal asserted on the second scan line DS is changed to a low level in order to put the third switching transistor Tr4 in a turned-on state. In this turned-on state, the drive transistor Trd is electrically connected to the third reference potential VDD. Thus, the pixel circuit 2 makes a transition from the no-light emission period to the light emission period. In a period between the timings T6 and T7, with the sampling transistor Tr1 still put in the turned-on state and the third switching transistor Tr4 just starting the turned-on state, a mobility compensation operation of the drive transistor Trd is carried out. That is to say, in accordance with this embodiment of the present invention, the mobility compensation operation of the drive transistor Trd is carried out in the period between the timings T6 and T7, that is, a period in which the later part of the video-signal sampling period overlaps the early part of the light emission period. It is to be noted that, in the early part included in the light emission period as a part in which the mobility compensation operation of the drive transistor Trd is carried out, the light emitting device EL is actually still in a state of a reverse bias so that the light emitting device EL does not actually emit light. In this mobility compensation period between the timings T6 and T7, while the electric potential at the gate electrode G of the drive transistor Trd is fixed at Vsig, the drain-source current Ids is flowing through the drive transistor Trd. Since the pixel circuit 2 is designed to have design parameters satisfying the relation (Vss1-Vth)<VthEL, the electric potential (Vss1-Vth) at the gate electrode S of the drive transistor Trd is lower than the threshold value VthEL of the light emitting device EL. Thus, the light emitting device EL is in a state of a reverse bias so that the light emitting device EL exhibits a simple capacitive characteristic in place of the diode characteristic. As a result, the driving current Ids generated by the drive transistor Trd flows to the signal holding capacitor Cs and the equivalent capacitance Coled of the light emitting device EL in an electrical charging process. That is to say, the driving current Ids flows to a compound capacitor with a capacitance C equal to (Cs+Coled). In FIG. 4, the electric potential on the source electrode S of the drive transistor Trd rises by an increase denoted by reference notation ΔV. Since the increase ΔV is eventually subtracted from the gate-source voltage Vgs held in the signal holding capacitor Cs, the increase ΔV is used as a negative feedback quantity in a negative feedback operation. Thus, by negatively feeding back the drain-source current Ids generated by the drive transistor Trd to the gate-source voltage Vgs of the same drive transistor Trd in this way, the drive transistor Trd can be compensated for variations in mobility μ from pixel to pixel. It is to be noted that, by adjusting the length t of the mobility compensation period between the timings T6 and T7, the negative feedback quantity ΔV can be optimized.

With the timing T7, the control signal asserted on the first scan line WS is changed to a low level in order to put the sampling transistor Tr1 in a turned-off state. Thus, the gate electrode G of the drive transistor Trd is electrically disconnected from the signal line SL. As a result, the application of the electric potential Vsig of the video signal to the gate electrode G of the drive transistor Trd is terminated. The gate electrode G of the drive transistor Trd is therefore put in a floating state, allowing the electric potential on the gate electrode G to rise. As a matter of fact, the electric potential on the gate electrode G of the drive transistor Trd rises in manner of being interlocked with the electric potential on the source electrode S of the drive transistor Trd in the bootstrap operation described before due to a capacitive coupling effect of the signal holding capacitor Cs. While the electric potential on the gate electrode G of the drive transistor Trd is rising in manner of being interlocked with the electric potential on the source electrode S of the drive transistor Trd, the gate-source voltage Vgs held in the signal holding capacitor Cs is sustained at (Vsig−ΔV+Vth). As the electric potential on the source electrode S of the drive transistor Trd rises, however, the light emitting device EL exists from the state of a reverse bias. Thus, the driving current Ids flows into the light emitting device EL, driving the light emitting device EL to actually start emitting light. With the gate-source voltage Vgs sustained at (Vsig−ΔV+Vth), the relation between the drain-source current Ids and the gate-source voltage Vgs is expressed by Equation (2) given below. Equation (2) is derived from Equation (1) given before by substituting the expression (Vsig−ΔV+Vth) into Equation (1) for reference notation Vsig as follows.

$$Ids=k\mu(Vgs-Vth)^2=k\mu(Vsig-\Delta V)^2 \quad (2)$$

In Equation (2), reference notation k denotes the value of the expression (½) (W/L) Cox (that is, k=(½) (W/L) Cox). Equation (2) no longer includes the term Vth. That is to say, it is obvious that magnitude of the driving current Ids supplied by the drive transistor Trd to the light emitting device EL is not dependent on the threshold voltage Vth of the drive transistor Trd. This is because, basically, the magnitude of the driving current Ids is determined by the electric potential Vsig of the video signal. In other words, the light emitting device EL emits light at a luminance determined by the electric potential Vsig of the video signal. Since the electric potential Vsig of the video signal is compensated by making use of the negative feedback quantity ΔV which just cancels the effect of the mobility μ used as a coefficient in Equation (2) representing a characteristic equation, the magnitude of the drain-source current Ids is essentially determined by only the electric potential Vsig of the video signal.

Finally, with a timing T8, the control signal asserted on the second scan line DS is changed to a high level in order to put the third switching transistor Tr4 in a turned-off state which ends the light emission period and terminates the field. Then, the pixel circuit 2 starts the next field in which the Vth (threshold-voltage) compensation operation, the mobility compensation operation and the light emission operation are repeated.

Figure 13:
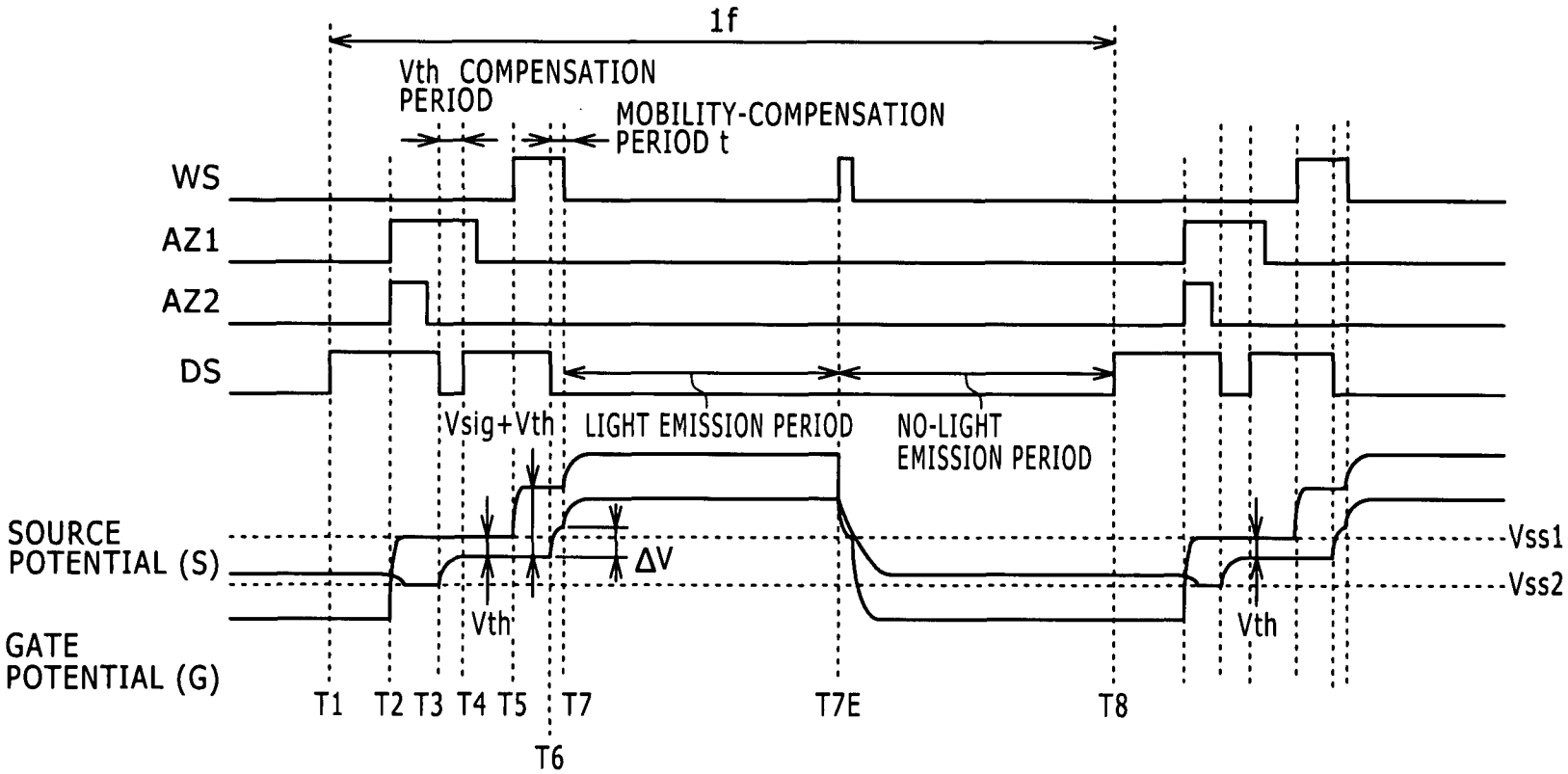
FIG. 13 is a timing diagram showing timing charts of a sequence of operations carried out by the pixel circuit 2 provided by an embodiment of the present invention as shown in the diagrams of FIGS. 9 to 11.

FIG. 13 is a timing diagram showing timing charts of a sequence of operations carried out by the pixel circuit 2 provided by an embodiment of the present invention as operations including a countermeasure against drifts of the threshold voltage Vth with the lapse of time. In order to make the explanation easy to understand, the same reference notations as those used in FIG. 12 are also used in FIG. 13 to denote things identical with their respective counterparts shown in FIG. 12. The timing diagram of FIG. 13 is different from the timing diagram of FIG. 12 in that, in the case of the timing diagram of FIG. 13, with a proper timing T7E between the timing T7 at the beginning of the light emission period and the timing T8 at the end of the light emission period or the end of the field, the light emission period is forcibly terminated to start the no-light emission period. In accordance with an embodiment of the present invention, in order to terminate the light emission period forcibly and start the no-light emission period, the write scanner 4 asserts the other control pulse on the first scan line WS with the timing T7E, putting the sampling transistor Tr1 in a turned-on state of applying a predetermined electric potential asserted on the signal line SL to the gate electrode G of the drive transistor Trd instantaneously before putting the sampling transistor Tr1 back in a turned-off state again by removing the other control pulse in order to cut off the predetermined reference potential from the gate electrode G. By applying the predetermined electric potential to the gate electrode G of the drive transistor Trd instantaneously, the gate-source voltage Vgs applied between the gate electrode G of the drive transistor Trd and the source electrode S of the drive transistor Trd can be put in a state of a reverse bias the magnitude of which is determined in accordance with the level of the video signal. Thus, the change of the threshold voltage Vth of the drive transistor Trd can be repressed.

Figure 14:
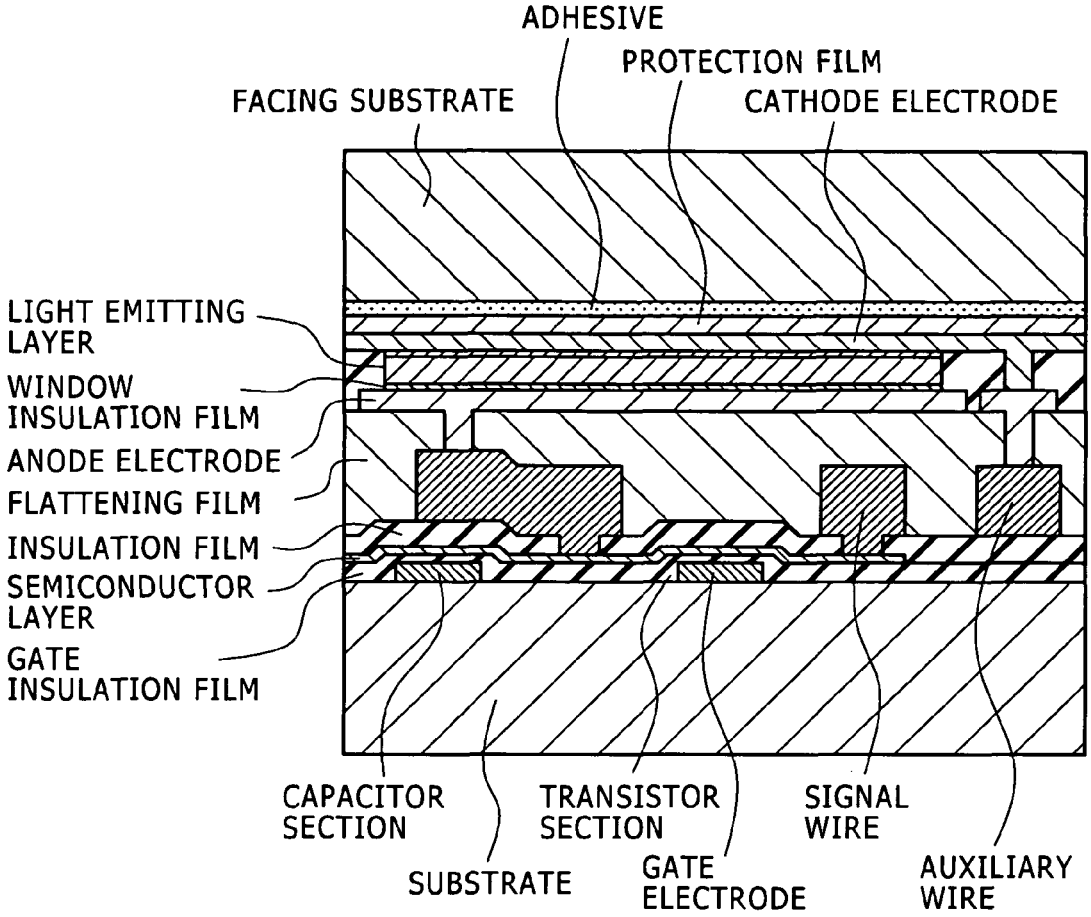
FIG. 14 is a model diagram showing the cross section of the structure of the pixel circuit 2 created on an insulation semiconductor substrate as a pixel circuit 2 employed in the image display apparatus according to an embodiment of the present invention.

The image display apparatus provided by an embodiment of the present invention is a thin film device like one shown in FIG. 14. FIG. 14 is a model diagram showing the cross section of the structure of the pixel circuit 2 created on an insulation semiconductor substrate as a pixel circuit 2 employed in the image display apparatus according to an embodiment of the present invention. As shown in FIG. 14, the pixel circuit includes a transistor section having a plurality of thin-film transistors, a capacitor section such as the signal holding capacitor and a light emitting section such as the organic EL device. The cross-sectional model diagram of FIG. 14 shows one thin-film transistor for the sake of simplicity. The components such as the transistor section and the capacitor section are created on the insulation semiconductor substrate by carrying out a TFT process. Then, the light emitting section such as the organic EL device is created as a layer over the transistor section and the capacitor section. An adhesive is then created on the light emitting device and a transparent facing substrate is stuck to the adhesive in order to form a flat display panel, sandwiching the adhesive in conjunction with the light emitting device.

Figure 15:
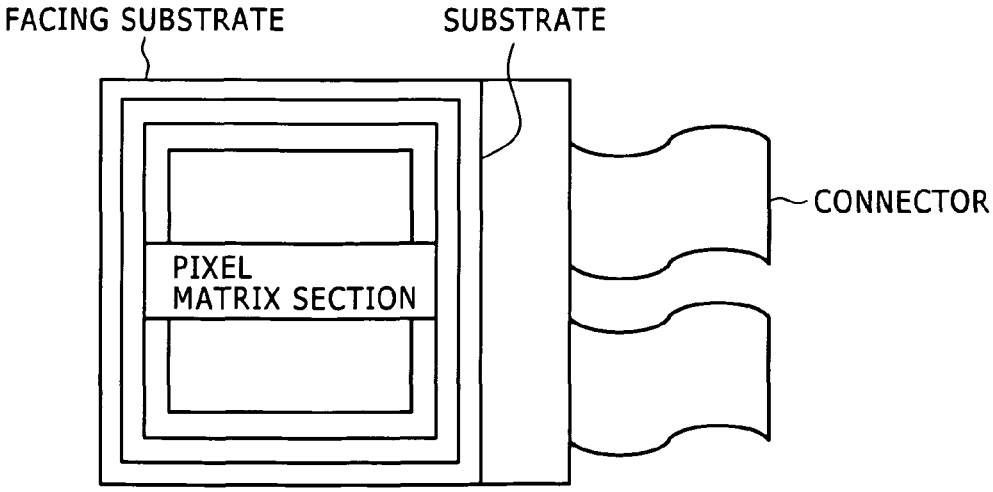
FIG. 15 is a diagram showing the top view of the modular configuration of the image display apparatus shown in the cross-sectional diagram of FIG. 14 as the image display apparatus according to an embodiment of the present invention.

FIG. 15 is a diagram showing the top view of the modular configuration of the image display apparatus shown in FIG. 14. As shown in the top-view diagram of FIG. 15, the image display apparatus according to an embodiment of the present invention has a flat modular shape. For example, a pixel matrix section is provided on the insulation semiconductor substrate. In the pixel matrix section, a plurality of pixel circuits are laid out to form a matrix. Each of the pixel circuits employs the organic EL device, the thin-film transistors and the thin-film signal holding capacitor. An adhesive surrounds the pixel matrix section which is also referred to as a pixel array section. Then, a transparent facing substrate made of a material such as the glass is stuck to the adhesive. In addition, if necessary, components such as color filters, a protection film and a light blocking film are provided over the transparent facing substrate. The display module may be provided with typically an FPC (Flexible Print Circuit) to serve as a connector for inputting signals from external sources to the pixel matrix section and outputting signals from the pixel matrix section to external sources.

In addition, the image display apparatus according to the embodiments of the present invention each has a flat display panel as described above and can each be used as a display unit of a variety of electronic instruments in all fields. Typical examples of the electronic instruments are a TV set, a digital camera, a notebook personal computer, a cellular phone and a video camera. The image display apparatus is used for displaying a video signal as an image of a video. The video image displayed by the image display apparatus is a signal supplied to the electronic instrument employing the image display apparatus or a signal generated in the electronic instrument itself.

Figure 16:
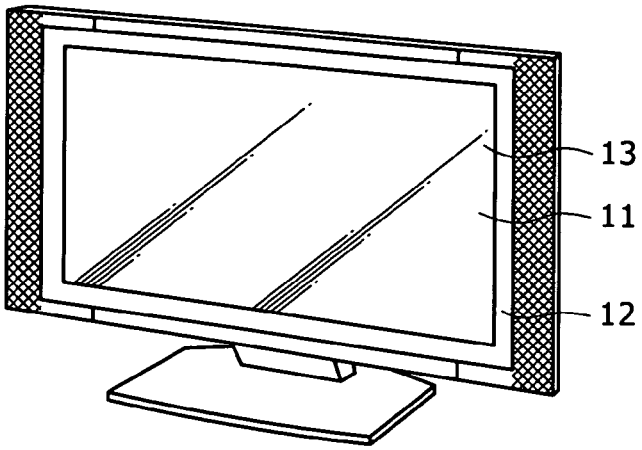
FIG. 16 is a diagram showing a perspective view of a TV set employing an image display apparatus according to an embodiment of the present invention.

FIG. 16 is a diagram showing a perspective view of a TV set employing an image display apparatus according to an embodiment of the present invention. As shown in FIG. 16, the TV set employs components including an image display screen 11, which has a front panel 12 and a filter glass board 13. In the case of the TV set, the image display apparatus according to an embodiment of the present invention is manufactured to serve as the image display screen 11.

Figure 17:
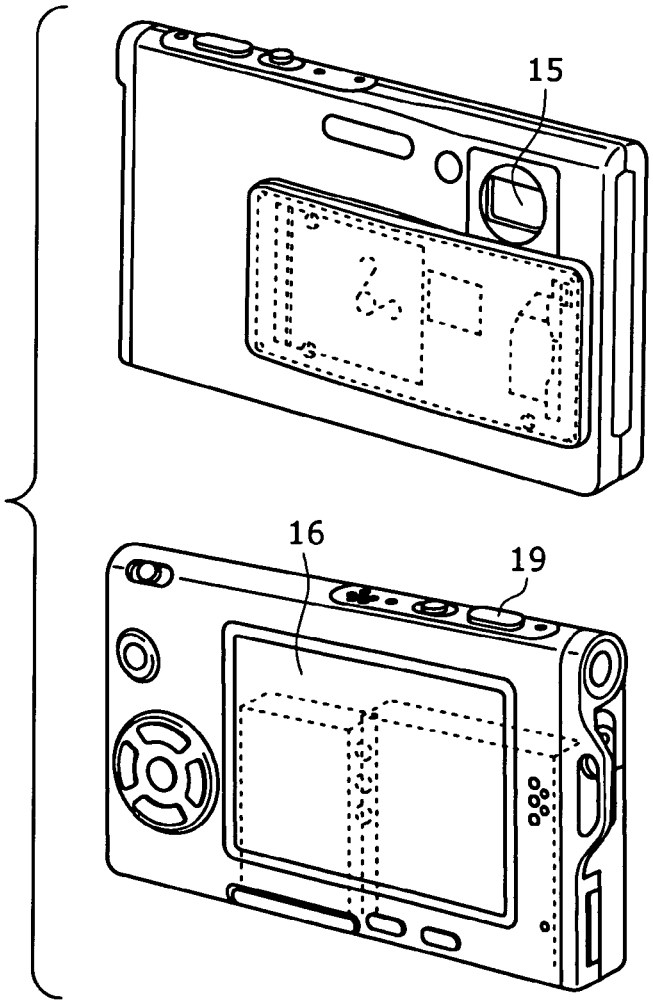
FIG. 17 is a plurality of diagrams each showing a perspective view a digital camera employing an image display apparatus according to an embodiment of the present invention.

FIG. 17 is a plurality of diagrams each showing a perspective view a digital camera employing an image display apparatus according to an embodiment of the present invention. To be more specific, the upper diagram shows the front view of the digital camera whereas the lower diagram shows the rear view of the digital camera. As shown in FIG. 17, the digital camera employs components including a photographing lens, a flash light emitting section 15, a display section 16, a control switch, a menu switch and a shutter 19. In the case of the digital camera, the image display apparatus according to an embodiment of the present invention is manufactured to serve as the display section 16.

Figure 18:
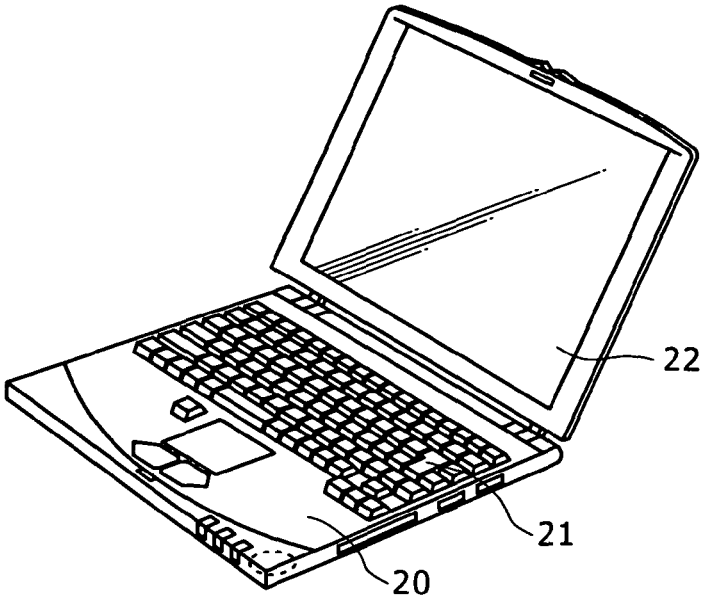
FIG. 18 is a diagram showing a perspective view of a notebook personal computer employing an image display apparatus according to an embodiment of the present invention.

FIG. 18 is a diagram showing a perspective view of a notebook personal computer employing an image display apparatus according to an embodiment of the present invention. As shown in FIG. 18, the notebook personal computer has components including a main unit 20 and a main-unit cover. The main unit includes a keyboard 21 to be operated by the user to enter an input such as a string of characters. On the other hand, the main-unit cover includes a display section 22 for displaying an image. In the case of the notebook personal computer, the image display apparatus according to an embodiment of the present invention is manufactured to serve as the display section 22.

Figure 19:
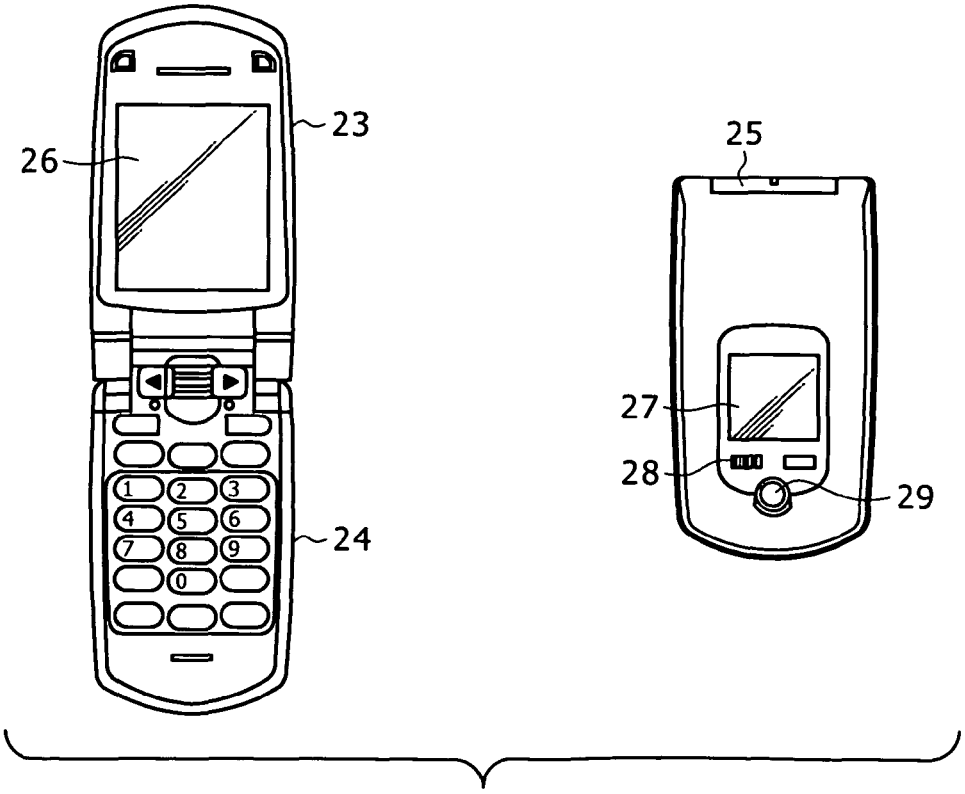
FIG. 19 is a plurality of diagrams each showing a perspective view a cellular phone employing an image display apparatus according to an embodiment of the present invention.

FIG. 19 is a plurality of diagrams each showing a perspective view a cellular phone employing an image display apparatus according to an embodiment of the present invention. To be more specific, the left diagram shows the cellular phone with the main-unit cover put in an opened state whereas the right diagram shows the cellular phone with the main-unit cover put in a closed state. As shown in FIG. 19, the cellular phone employs components including an upper-side case 23, a lower-side case 24, a link section (that is, a hinge section in this case) 25, a display screen 26, a sub-display screen 27, a picture light 28 and a camera 29. In the case of the cellular phone, the image display apparatus according to an embodiment of the present invention is manufactured to serve as the display screen 26.

Figure 20:
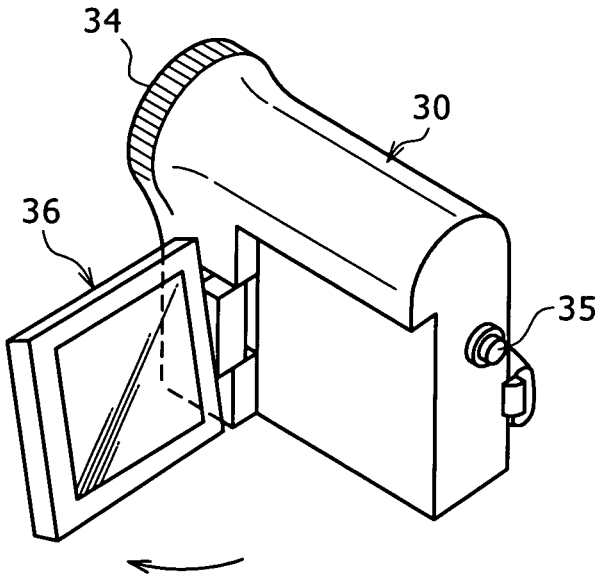
FIG. 20 is a diagram showing a perspective view of a video camera employing an image display apparatus according to an embodiment of the present invention.

FIG. 20 is a diagram showing a perspective view of a video camera employing an image display apparatus according to an embodiment of the present invention. As shown in FIG. 20, the notebook personal computer has components including a main unit 30, a lens 34 oriented in the forward direction to serve as a lens for taking a video of a subject of photographing, a start/stop switch 35 to be operated when carrying out a photographing operation and a monitor 36. In the case of the video camera, the image display apparatus according to an embodiment of the present invention is manufactured to serve as the monitor 36.

It should also be understood by those skilled in the art that a variety of modifications, combinations, sub-combinations and alterations may occur, depending on design requirements and other factors as far as they are within the scope of the appended claims or the equivalents thereof.

What is claimed is:

1. An image display apparatus comprising:

a plurality of pixel circuits arranged in a matrix configuration within a pixel array section, at least one of the pixel circuits including a sampling transistor, a drive transistor, a holding capacitor, and a light emitting device; and a drive section configured to drive the pixel array section, the drive section being configured to carry out a sequential scanning operation on scan lines, with the drive section providing a predetermined reference potential and a video signal on signal lines according to the sequential scanning operation, wherein the sampling transistor is connected to one of the signal lines to selectively provide the video signal and the predetermined reference potential to the holding capacitor, the drive transistor includes a gate electrode, a first current electrode and a second current electrode, the gate electrode being coupled to the holding capacitor, the first current electrode being coupled to a power-supply line and the second current electrode being coupled to the light emitting device, the sampling transistor enters a turned-on state in accordance with a control signal supplied by one of the scan lines to sample the video signal into the signal holding capacitor, the drive transistor supplies the light emitting device with a driving current having a magnitude according to the video signal held by the signal holding capacitor, the sampling transistor provides the predetermined reference potential to cause a transition from a light emission period to a non-light emission period, the sampling transistor is in a turned-on state during a time period wherein a threshold voltage of the drive transistor is stored in the signal holding capacitor, when the video signal is set at a white level, the predetermined reference potential causes the drive transistor to be put in a state of a maximum reverse bias, and when the video signal is set at a black level, the predetermined reference potential causes drive transistor is put in a state of a minimum reverse bias.

2. The image display apparatus according to claim 1, wherein the sampling transistor applies the predetermined reference potential to the gate electrode of the drive transistor to reverse an electric potential at the gate electrode of the drive transistor with respect to a fixed electric potential on the power supply line to put the drive transistor in a state of a reverse bias.

3. The image display apparatus according to claim 1, wherein a ratio of the light emission period to the no-light emission period is adjusted such that a threshold-voltage change in a state of a forward bias of the drive transistor during the light emission period is canceled by a threshold-voltage change in a state of a reverse bias of the drive transistor during the no-light emission period.

4. The image display apparatus according to claim 1, wherein, prior to an operation to sample the video signal, the driving current is flowed through the drive transistor until the drive transistor is put in a turned-off state and a voltage, which is appearing between the gate and the second current electrode of the drive transistor when the driving current flowing through the drive transistor is cut off, is stored in the signal holding capacitor in order to carry out a threshold-voltage compensation operation to compensate the drive transistor for an effect of variations in threshold voltage from pixel to pixel.

5. The image display apparatus according to claim 1, wherein, when the sampling transistor is put in a turned-on state in order to store the video signal in the signal holding capacitor, the driving current flowing through the drive transistor is negatively fed back to the signal holding capacitor during a mobility compensation period determined in advance in order to compensate the drive transistor for an effect of variations in carrier mobility.

6. An electronic instrument comprising the image display apparatus according to claim 1.

7. The electronic instrument according to claim 6, wherein the sampling transistor applies the predetermined reference potential to the gate electrode of the drive transistor to reverse an electric potential at the gate electrode of the drive transistor with respect to a fixed electric potential on the power supply line to put the drive transistor in a state of a reverse bias.

8. The electronic instrument according to claim 6, wherein a ratio of the light emission period to the no-light emission period is adjusted such that a threshold-voltage change in a state of a forward bias of the drive transistor during the light emission period is canceled by a threshold-voltage change in a state of a reverse bias of the drive transistor during the no-light emission period.

9. The electronic instrument according to claim 6, wherein, prior to an operation to sample the video signal, the driving current is flowed through the drive transistor until the drive transistor is put in a turned-off state and a voltage, which is appearing between the gate and the second current electrode of the drive transistor when the driving current flowing through the drive transistor is cut off, is stored in the signal holding capacitor in order to carry out a threshold-voltage compensation operation to compensate the drive transistor for an effect of variations in threshold voltage from pixel to pixel.

10. The electronic instrument according to claim 6, wherein, when the sampling transistor is put in a turned-on state in order to store the video signal in the signal holding capacitor, the driving current flowing through the drive transistor is negatively fed back to the signal holding capacitor during a mobility compensation period determined in advance in order to compensate the drive transistor for an effect of variations in carrier mobility.

11. A method of driving an image display apparatus that includes a plurality of pixel circuits arranged in a matrix configuration within a pixel array section, at least one of the pixel circuits including a sampling transistor, a drive transistor, a holding capacitor, and a light emitting device, the drive transistor including a gate electrode, a first current electrode and a second current electrode, the gate electrode being coupled to the holding capacitor, the first current electrode of being coupled to a power-supply line and the second current electrode being coupled to the light emitting device, the image display apparatus further including a drive section configured to drive the pixel array section, the drive section being configured to carry out a sequential scanning operation on scan lines, with the drive section providing a predetermined reference potential and a video signal on signal lines according to the sequential scanning operation, the method comprising:

selectively providing the video signal and the predetermined reference potential to the holding capacitor through the sampling transistor;

causing the sampling transistor to enter a turned-on state in accordance with a control signal supplied by one of the scan lines to sample the video signal into the signal holding capacitor, supplying, through the drive transistor, the light emitting device with a driving current having a magnitude according to the video signal held by the signal holding capacitor, providing, by the sampling transistor, the predetermined reference potential to cause a transition from a light emission period to a non-light emission period, and causing the sampling transistor to be in a turned-on state during a time period wherein a threshold voltage of the drive transistor is stored in the signal holding capacitor, wherein when the video signal is set at a white level, the predetermined reference potential causes the drive transistor to be put in a state of a maximum reverse bias; and when the video signal is set at a black level, the predetermined reference potential causes drive transistor is put in a state of a minimum reverse bias.

12. The method according to claim 11, wherein the sampling transistor applies the predetermined reference potential to the gate electrode of the drive transistor to reverse an electric potential at the gate electrode of the drive transistor with respect to a fixed electric potential on the power supply line to put the drive transistor in a state of a reverse bias.

13. The method according to claim 11, wherein a ratio of the light emission period to the no-light emission period is adjusted such that a threshold-voltage change in a state of a forward bias of the drive transistor during the light emission period is canceled by a threshold-voltage change in a state of a reverse bias of the drive transistor during the no-light emission period.

14. The method according to claim 11, wherein, prior to an operation to sample the video signal, the driving current is flowed through the drive transistor until the drive transistor is put in a turned-off state and a voltage, which is appearing between the gate and the second current electrode of the drive transistor when the driving current flowing through the drive transistor is cut off, is stored in the signal holding capacitor in order to carry out a threshold-voltage compensation operation to compensate the drive transistor for an effect of variations in threshold voltage from pixel to pixel.

15. The method according to claim 11, wherein, when the sampling transistor is put in a turned-on state in order to store the video signal in the signal holding capacitor, the driving current flowing through the drive transistor is negatively fed back to the signal holding capacitor during a mobility compensation period determined in advance in order to compensate the drive transistor for an effect of variations in carrier mobility.

16. An image display apparatus comprising:

a plurality of pixel circuits arranged in a matrix within a pixel array section, at least one of the pixel circuits including a first transistor, a second transistor, a holding capacitor, and a light emitting device, wherein the first transistor is configured to provide a predetermined reference potential to the holding capacitor to cause a transition from a light emission period to a non-light emission period, the second transistor is connected between a power-supply line and the light emitting device, the second transistor is configured to supply a driving current having a magnitude according to a video signal held by the holding capacitor, when the video signal is set at a white level, the second transistor is put in a state of a maximum reverse bias; and when the video signal is set at a black level, the second transistor is put in a state of a minimum reverse bias.

17. The image display apparatus according to claim 16, wherein a ratio of the light emission period to the non-light emission period is adjusted such that a threshold-voltage change in a state of a forward bias of the second transistor during the light emission period is canceled by the threshold-voltage change in a state of a reverse bias of the second transistor during the non-light emission period.

18. The image display apparatus according to claim 16, wherein, prior to an operation to sample the video signal, the driving current is flowed through the second transistor until the second transistor is put in a turned-off state and a voltage, which is appearing between the gate and a second current electrode of the second transistor when the driving current flowing through the second transistor is cut off, is stored in the holding capacitor in order to carry out a threshold-voltage compensation operation to compensate the second transistor for an effect of variations in a threshold voltage from pixel to pixel.

19. The image display apparatus according to claim 16, wherein, when the first transistor is put in a turned-on state in order to store the video signal in the holding capacitor, the driving current flowing through the second transistor is negatively fed back to the holding capacitor during a mobility compensation period determined in advance in order to compensate the second transistor for an effect of variations in carrier mobility.

* * * * *